US010352547B2

(12) United States Patent
Pickard et al.

(10) Patent No.: US 10,352,547 B2
(45) Date of Patent: Jul. 16, 2019

(54) LIGHTING DEVICES, FIXTURE STRUCTURES AND COMPONENTS FOR USE THEREIN

(75) Inventors: Paul Kenneth Pickard, Morrisville, NC (US); Gerald H. Negley, Durham, NC (US); Antony Paul Van De Ven, Hong Kong SAR (CN); Nicholas W. Medendorp, Jr., Raleigh, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 811 days.

(21) Appl. No.: 13/026,495

(22) Filed: Feb. 14, 2011

(65) Prior Publication Data

US 2012/0206911 A1 Aug. 16, 2012

(51) Int. Cl.

| | |
|---|---|
| ***F21V 29/70*** | (2015.01) |
| ***F21S 8/02*** | (2006.01) |
| ***F21V 3/04*** | (2018.01) |
| ***F21V 3/06*** | (2018.01) |
| *F21Y 115/10* | (2016.01) |
| *F21Y 113/13* | (2016.01) |

(52) U.S. Cl.

CPC ..... *F21V 29/70* (2015.01); *F21S 8/026* (2013.01); *F21V 3/049* (2013.01); *F21V 3/06* (2018.02); *F21Y 2113/13* (2016.08); *F21Y 2115/10* (2016.08)

(58) Field of Classification Search

CPC ..... F21Y 2105/00–16; F21V 29/70–83
USPC ..... 362/231, 235, 249.02, 355
See application file for complete search history.

(56) References Cited

U.S. PATENT DOCUMENTS

| | | | | |
|---|---|---|---|---|
| 6,578,990 | B2 * | 6/2003 | Hildenbrand et al. | 362/341 |
| 6,964,489 | B2 * | 11/2005 | Blume et al. | 362/27 |
| 7,794,114 | B2 | 9/2010 | Medendorp, Jr. | |
| 2006/0203465 | A1 * | 9/2006 | Chang et al. | 362/29 |
| 2008/0089069 | A1 * | 4/2008 | Medendorp | F21S 8/04 362/294 |
| 2009/0323326 | A1 * | 12/2009 | Chang | 362/235 |
| 2011/0074265 | A1 | 3/2011 | Van de Ven | |
| 2011/0075410 | A1 | 3/2011 | Negley et al. | |
| 2012/0014132 | A1 * | 1/2012 | Chiang | G02F 1/133606 362/607 |

* cited by examiner

*Primary Examiner* — Sean P Gramling
(74) *Attorney, Agent, or Firm* — Burr & Brown, PLLC

(57) ABSTRACT

In some embodiments, a lighting device comprising two or more light sources and an optical device configured to enhance uniformity of light emitted from the light sources and emerging from a surface of the optical device, an average distance between light sources less than one half of the square root of the area of the surface divided by the number of light sources. In some embodiments, a fixture structure comprising a reflective structure and a heat conductor in contact with the reflective structure and covering not more than 30 percent of the surface area of the reflective structure. In some embodiments, a lighting device comprising a fixture structure, at least one light source mounted on one substrate, and at least one light source mounted on another substrate. Other fixture structures and lighting devices.

24 Claims, 6 Drawing Sheets

LIGHTING DEVICES, FIXTURE STRUCTURES AND COMPONENTS FOR USE THEREIN

FIELD OF THE INVENTIVE SUBJECT MATTER

The present inventive subject matter relates to the field of lighting and illumination, such as general illumination, traffic signals, color wall wash lighting, backlights and displays. In some aspects, the present inventive subject matter relates to a lighting device that comprises one or more solid state light emitters and that can be installed in a building (e.g., an office building, a warehouse, a home, a business, etc.). In some aspects, the present inventive subject matter relates to a fixture structure in which one or more light sources can be mounted to provide a lighting device. In some aspects, the present inventive subject matter relates to providing lighting devices and/or components therefor that can be used in place of incandescent lighting devices and/or fluorescent lighting devices, and/or components thereof.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light sources are very energy-inefficient—about ninety percent of the electricity they consume is released as heat rather than light. Fluorescent light sources are more efficient than incandescent light sources (by a factor of about 10) but are still less efficient than solid state light emitters, such as light emitting diodes.

In addition, as compared to the normal lifetimes of solid state light emitters, e.g., light emitting diodes, incandescent light sources have relatively short lifetimes, i.e., typically about 750-1000 hours. In comparison, light emitting diodes, for example, have typical lifetimes between 50,000 and 70,000 hours. Fluorescent light sources have longer lifetimes than incandescent lights (e.g., fluorescent light sources typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light source is less than the lifetime of the fixture, the need for periodic change-outs is presented. The impact of the need to replace light sources is particularly pronounced where access is difficult (e.g., vaulted ceilings, bridges, high buildings, highway tunnels) and/or where change-out costs are extremely high.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

The color of visible light output by a light source, and/or the color of blended visible light output by a plurality of light sources can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular pair of coordinates on the 1931 Diagram consists of hues that would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value (e.g., 0.1 unit, 0.02 unit, etc.), in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus obey Planck's equation: $E(\lambda)=A\lambda^{-5}/(e^{(B/T)}-1)$, where E is the emission intensity, $\lambda$ is the emission wavelength, T is the color temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants (or combinations of illuminants, such as combinations of light sources of different hues) that produce light that is on or near the blackbody locus can thus be described in terms of their color temperature.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

The emission spectrum of any particular light emitting diode is typically concentrated around a single wavelength (as dictated by the light emitting diode's composition and structure), which is desirable for some applications, but not desirable for others, (e.g., for providing general illumination, such an emission spectrum provides a very low CRI Ra).

Blends of light of two or more colors (or wavelengths) can be used to provide light that is perceived as white light.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

LEDs are increasingly being used in lighting/illumination applications, such as traffic signals, color wall wash lighting, backlights, displays and general illumination, with one ultimate goal being a replacement for incandescent lighting devices and/or fluorescent lighting devices. In order to provide a broad spectrum light source, such as a white light source, from a relatively narrow spectrum light source, such as an LED, the relatively narrow spectrum of the LED may be shifted and/or spread in wavelength.

For example, a white LED may be formed by coating a blue emitting LED with an encapsulant material, such as a resin or silicon, that includes therein a wavelength conversion material, such as a YAG:Ce phosphor, that emits yellow light in response to stimulation with blue light. Some, but not all, of the blue light that is emitted by the LED is absorbed by the phosphor, causing the phosphor to emit yellow light. The blue light emitted by the LED that is not absorbed by the phosphor combines with the yellow light emitted by the phosphor, to produce light that is perceived as white by an observer. Other combinations also may be used. For example, a red emitting phosphor can be mixed with the yellow phosphor to produce light having better color temperature and/or better color rendering properties. Alternatively, one or more red LEDs may be used to supplement the light emitted by the yellow phosphor-coated blue LED. In other alternatives, separate red, green and blue LEDs may be used. Moreover, infrared (IR) or ultraviolet (UV) LEDs may be used. Finally, any or all of these combinations may be used to produce colors other than white.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

LEDs also may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria—Version* 1.1", Final: Dec. 19, 2008, the disclosure of which is hereby incorporated herein by reference in its entirety as if set forth fully herein.

Heat is a major concern in obtaining a desirable operational lifetime for solid state light emitters. As is well known, an LED also generates considerable heat during the generation of light. The heat is generally measured by a "junction temperature", i.e., the temperature of the semiconductor junction of the LED. In order to provide an acceptable lifetime, for example, an L70 of at least 25,000 hours, it is desirable to ensure that the junction temperature should not be above 85° C. In order to ensure a junction temperature that is not above 85° C., various heat sinking schemes have been developed to dissipate at least some of the heat that is generated by the LED. See, for example, Application Note: CLD-APO6.006, entitled *Cree® XLamp® XR Family & 4550 LED Reliability*, published at cree.com/xlamp, September 2008.

In order to encourage development and deployment of highly energy efficient solid state lighting (SSL) products to replace several of the most common lighting products currently used in the United States, including 60-Watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

There exist a wide variety of lighting devices that comprise any of a wide variety of light sources (e.g., incandescent light sources, fluorescent light sources, solid state light sources, etc., and combinations thereof). For example, an architectural lighting device has been provided that comprises a large number of light emitting diodes mounted on a first major surface of a circuit board that is substantially planar (defining a first plane), a heat sink in contact with a second major surface of the circuit board (the second surface being opposite to the first surface, relative to the circuit board), a diffusive lens having a first major lens surface and a second major lens surface on opposite sides of the lens and substantially parallel to the first major surface of the circuit board, in which at least some of the light emitted by the light emitting diodes impinges the first major lens surface and exits the lighting device from the second major lens surface, and a reflective structure that comprises a back wall on which the circuit board is mounted and side walls that extend from the back wall to respective edges of the lens, whereby the reflective surface and the lens define a space in which the circuit board and the light emitting diodes are located, and in which light emitted by the light emitting diodes can mix prior to exiting the lighting device through the lens. For example, FIGS. 14 and 15 schematically depict a lighting device 140 that comprises a circuit board 141, a plurality of light emitting diodes 142, a heat sink 143, a lens 144 (having a first major lens surface 145 and a second major lens surface 146, where at least some light emitted by the light emitting diodes 142 impinges on the first major lens surface 145 and exits the lighting device 140 from the second major lens surface 146), and a reflector 147 (having a back wall 148 and four side walls 149).

BRIEF SUMMARY

As noted above, the present inventive subject matter relates to the field of lighting and illumination.

In some aspects, the inventive subject matter relates to lighting devices that can emit significant amounts of light, that can emit light that is substantially uniform in color (e.g., over time and/or over a large area of an emission surface), that can emit light that is substantially uniform in brightness (e.g., over time and/or over a large area of an emission surface), in which individual light sources that are included in the lighting device are less discernable or not discernable, in which adequate heat dissipation is provided so that light sources and other components do not become heated above desirable temperatures, that can provide high efficacy (e.g., wall plug efficiency), that can satisfy specific geometrical constraints (e.g., maximum height), that provide desirable aesthetic qualities, and/or that can be produced at acceptable or low cost.

In accordance with an aspect of the present inventive subject matter, there are a number of challenges to making a low cost lighting fixture that provides a significant amount of light (e.g., greater than or equal to 2,000 lumens, greater than 3,000 lumens, greater than 4,000 lumens, etc.). These problems in implementation can be compounded when using a multi-color light source such as BSY (defined below) light emitting diodes plus red light emitting diodes. The problems can include:

providing adequate color mixing, so that the light appears to be all one color;

providing adequate light spreading across the face of a large lens;

providing a large enough mixing chamber that individual light sources (e.g., light emitting diodes) are not discernable through the diffuser, and providing small enough spacing between light sources for this same purpose (these two characteristics can be interrelated, in that shorter mixing distance requires closer spacing between the light sources, and longer mixing distances can allow for wider spacing between the light sources, at least to a point);

providing adequate heat sink surface area to reject the heat created in the fixture;

interfacing the light sources (e.g., light emitting diodes) to the heat sink (e.g., via a circuit board, such as a metal core printed circuit board) and thermal interface material;

achieving significant efficacy (e.g., 70 lumens per Watt or greater); and/or achieving some or all of the above provisions within the maximum height specified for the fixture (e.g., 5 or 6 inches), with an acceptable aesthetic which provides a "quiet ceiling" and at an attractive cost.

For example, in one specific aspect of the present inventive subject matter, there is provided a lighting device that can be used in place of a lighting device like the lighting device 140 depicted in FIGS. 14 and 15. While lighting devices like the lighting device 140 depicted in FIGS. 14 and 15 can provide many beneficial characteristics, lighting devices in accordance with the present inventive subject matter can provide characteristics that are improved relative to lighting devices like the one depicted in FIGS. 14 and 15. For example, as discussed below, embodiments are provided in accordance with the present inventive subject matter that are analogous to the lighting device 140, but in which:

the heat sink 143 required in the lighting device 140 is not necessary and can be smaller or eliminated altogether, thereby providing opportunity to reduce thickness of the lighting device (in a direction analogous to the direction that is perpendicular to the major surfaces of the circuit board 141 and the major surfaces of the lens 144) and to reduce manufacturing cost;

the space required for mixing of light of different colors (if the lighting device includes light sources that emit light of different colors) can be smaller, thereby providing opportunity to reduce thickness of the lighting device and to reduce manufacturing cost;

a smaller circuit board can be employed, or a number of smaller circuit boards having a smaller combined size can be employed, thereby providing opportunity to reduce manufacturing cost;

light sources can be spaced from one another (e.g., from their closest neighbor or neighbors) by smaller distances (i.e., they can be more closely packed), thereby providing better mixing of light (and, where different light sources emit light of differing hues, better color mixing of light) with given dimensions for color mixing;

light sources can be added to and/or subtracted from lighting devices (e.g., as light emitting diodes become more efficient and able to provide greater lumen output, lighting devices with comparable total lumen output can be made using fewer light emitting diodes), without creating a need for other adjustments to the extent that would otherwise be created;

the uniformity of light brightness (e.g., measured in lumens) and/or the uniformity of light color can be better across a surface through which light exits the lighting device and/or across larger surfaces;

high efficacy can be achieved; and/or overall equipment cost and/or operating cost can be maintained or reduced.

For instance, in some conventional lighting devices, if one or more light sources (e.g., light emitting diodes) are removed, brightness uniformity on the face of the lens and/or color uniformity on the face of the lens can be reduced. Similarly, in some conventional devices, if one or more light sources (e.g., light emitting diodes) are added (or substituted for others), e.g., to add a blue light emitting diode to boost CRI Ra or to add a high brightness red light emitting diode, brightness uniformity on the face of the lens and/or color uniformity on the face of the lens can be reduced.

As discussed below, in some aspects in accordance with the present inventive subject matter, there are provided lighting devices in which:

light sources (e.g., solid state light emitters) are mounted (counter-intuitively) in clusters on a plurality of smaller circuit boards (i.e., rather than the light sources being spread out uniformly on a single large circuit board, one or more groups of light sources are provided in which light sources are closer together), which smaller circuit boards together have a combined surface area that is smaller (in some instances, much smaller, such as at least 80 percent less surface area) than the surface area of a circuit board that the smaller circuit boards replace;

each cluster of light sources can comprise light sources that emit light of different hues (in situations where the lighting device comprises light sources that emit light of different hues);

a separate heat sink (or heat sinks) is not provided, and instead heat generated by the clusters of light sources is conducted to a reflector (comprising e.g., sheet metal), e.g., with the aid of material with anisotropic heat conductivity, so that heat travels through the reflector and is dissipated from a very large surface area of the reflector (in some embodiments, at least portions of which can be exposed to room air, which in many instances can provide a greater temperature difference (delta T) for heat rejection than if it were exposed only to plenum air); and/or one or more optical devices can be provided that is/are configured to enhance uniformity of light emerging from one or more exit surfaces of the optical device (or optical devices)(such optical devices can allow for the changing of the number of light sources, and/or their respective colors of emission, without adversely affecting the color uniformity or the brightness uniformity of the output light, or without affecting one or both uniformity aspects to as large a degree as would otherwise be the case, and in addition to allowing for changing the number of light sources, in some cases it is possible to provide flexibility of the use of different colors of light emission of light sources in a lighting device (i.e., light sources can be substituted for one another) to achieve high CRI Ra light with multiple color temperatures using different light source combinations having different colors of emission).

In some aspects in accordance with the present inventive subject matter, one or more optical devices can be provided that has/have controlled reflective/transmissive properties at different locations (i.e., different regions of an optical device can reflect light or transmit light to specified degrees at specific locations).

In some aspects, the present inventive subject matter relates to lighting devices that comprise at least two light sources and at least a first optical device.

In some aspects, the present inventive subject matter relates to lighting devices that comprise at least two substrates and at least a first optical device.

In some aspects, the present inventive subject matter relates to lighting devices that comprise at least a first reflective structure and at least two light sources.

In some aspects, the present inventive subject matter relates to lighting devices that comprise at least a first reflective structure and at least a first optical device.

In some aspects, the present inventive subject matter relates to lighting devices that comprise at least a first reflective structure and at least two substrates.

In some aspects, the present inventive subject matter relates to lighting devices and fixture structures that comprise at least a first reflective structure and at least a first heat conductor.

In accordance with a first aspect of the present inventive subject matter, there is provided a lighting device that comprises at least two light sources and at least a first optical device, in which:

the first optical device has at least a first light exit surface and is configured to enhance uniformity of light emitted from the light sources and emerging from the first light exit surface, and an average distance between each light source and its nearest neighboring light source is less than the value of (a surface area of the first light exit surface divided by a total number of light sources in the lighting device)$^{1/2}$, divided by two.

The expression "average distance between each light source and its nearest neighboring light source", as used herein, means, for each light source, the shortest distance between a point from which light is emitted from the light source (when the light source is energized) to a point from which light is emitted from another light source (when that light source is energized).

In accordance with a second aspect of the present inventive subject matter, there is provided a lighting device that comprises at least two light sources comprising at least first and second solid state light emitters and at least a first optical device, in which:

the first optical device has at least a first light exit surface, an average distance between each light source and its nearest neighboring light source is less than the value of (a surface area of the first light exit surface divided by a total number of light sources in the lighting device)$^{1/2}$, divided by two, when energy is supplied to the lighting device, light emerging from each of at least 1000 non-overlapping square regions of the first light exit surface has a color hue that is within 0.01 unit of a first color point on a 1976 CIE Chromaticity Diagram and a brightness that is within 5 percent of a first brightness, and each of the at least 1000 non-overlapping square regions comprises 0.08 percent of a total surface area of the first light exit surface.

The expression "non-overlapping square regions of the first light exit surface", as used herein, means regions that would be defined by conceptually projecting a two-dimensional square grid (having respective square regions that do not overlap one another) over the first light exit surface (which may be three-dimensional or substantially two-dimensional).

In accordance with a third aspect of the present inventive subject matter, there is provided a fixture structure that comprises at least a first reflective structure and at least a first heat conductor, in which:

the first heat conductor is in contact with the first reflective structure, and the at least a first heat conductor covers not more than 30 percent (in some cases not more than 20 percent, and in some cases not more than 10 percent) of the total surface area of the first reflective structure.

The expression "covers not more than 30 percent of the total surface area of the first reflective structure" (or the expression "covering not more than 30 percent of the total surface area of the first reflective structure") (or similar expressions that recite different percentages), or similar expressions, as used herein, means that the heat conductor covers (or a combination of two or more heat conductors cover) a percentage of the entire surface area of the first reflective structure that does not exceed 30 percent, e.g., in the embodiment depicted in FIGS. 1-4, the total surface area of the reflective structure 14 includes both the inner and outer surfaces of the reflective structure 14 (i.e., including both the surfaces facing the heat conductors 16 and the surfaces facing toward the optical device 15) as well as the edges of the reflective structure 14 (i.e., the thin regions between inner surfaces and outer surfaces). The term "covers" (or "covering") does not require direct contact (i.e., there can be intervening structure(s)) between the heat conductor and the reflective structure.

In accordance with a fourth aspect of the present inventive subject matter, there is provided a fixture structure that comprises at least a first reflective structure and at least a first heat conductor, in which:

the first heat conductor is in contact with the first reflective structure, the at least a first heat conductor has a first heat conductivity in a first direction and a second heat conductivity in a second direction, and the first heat conductivity is at least twice the second heat conductivity.

In accordance with a fifth aspect of the present inventive subject matter, there is provided a lighting device that comprises at least two light sources and means for enhancing uniformity of light emitted from the lighting device from a first light exit surface (i.e., color hue and/or brightness), in which an average distance between each light source and its nearest neighboring light source is less than the value of (a surface area of the first light exit surface divided by a total number of light sources in the lighting device)$^{1/2}$, divided by two.

In accordance with a sixth aspect of the present inventive subject matter, there is provided a fixture structure that comprises at least a first reflective structure, and means for conducting heat in contact with the first reflective structure, the means for conducting heat covering not more than 30 percent of a total surface area of the first reflective structure.

In some aspects of the present inventive subject matter, fewer light sources can be employed (e.g., one or more light sources (e.g., light emitting diodes) can be removed relative to conventional lighting devices), and brightness uniformity on the face of the lens and/or color uniformity on the face of the lens can be maintained or elevated (or not decreased as much as would otherwise be the case) because the effect of the removal of one or more light sources is swamped by the other light sources, due to close proximity of light sources relative to one another (and in some cases, close proximity of one or more pluralities of light sources) and/or the uniformity of brightness and/or color provided by the one or more optical devices.

In some aspects of the present inventive subject matter, more light sources can be employed (e.g., one or more light sources (e.g., light emitting diodes) can be added (or substituted for others) relative to conventional lighting devices, e.g., a blue light emitting diode can be added to boost CRI Ra and/or a high brightness red light emitting diode can be added, and/or light source replacements and/or additions can be made to change color temperature of the light output from the lighting device, while brightness uniformity on the face of the lens and/or color uniformity on the face of the lens can be maintained or elevated (or not decreased as much as would otherwise be the case) because the effect of the addition of one or more light sources (and/or substitution) is swamped by the other light sources, due to close proximity of light sources relative to one another (and in some cases, close proximity of one or more pluralities of light sources) and/or the uniformity of brightness and/or color provided by the one or more optical devices.

In some aspects, the present inventive subject matter relates to lighting devices (and components therefor) that can be used as architectural lighting (e.g., that can be used to replace a conventional architectural lighting device), and/or to replace troffer lighting, and/or to replace surface mount lighting (e.g., surface mount fluorescent fixtures).

The inventive subject matter may be more fully understood with reference to the accompanying drawings and the following detailed description of the inventive subject matter.

BRIEF DESCRIPTION OF THE DRAWING FIGURES

FIGS. 1-4 depict a lighting device 10 according to the present inventive subject matter. FIG. 1 is a sectional side view of the lighting device 10. FIG. 2 is a sectional view of the lighting device 10 along the plane 2-2 in FIG. 1. FIG. 3 is a top view of the lighting device 10. FIG. 4 is a bottom view of the lighting device 10.

Figure 12:
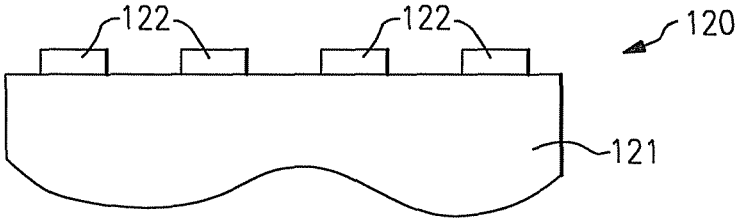

FIG. 12 schematically depicts an optical device 120.

Figure 13:
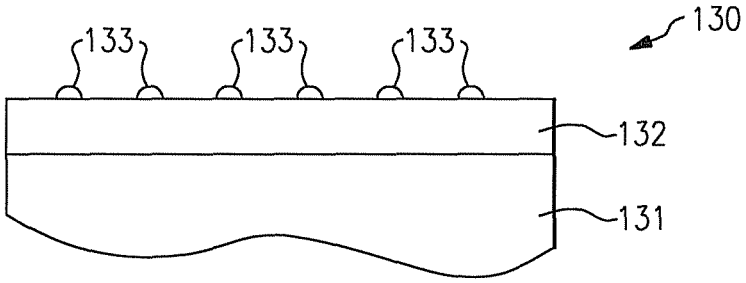

FIG. 13 is a schematic side view of an optical device 130 according to the present inventive subject matter.

Figure 14:
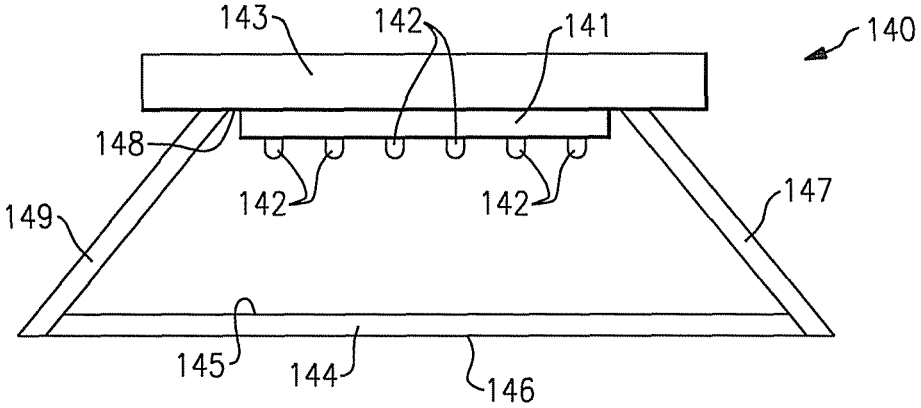
Figure 15:
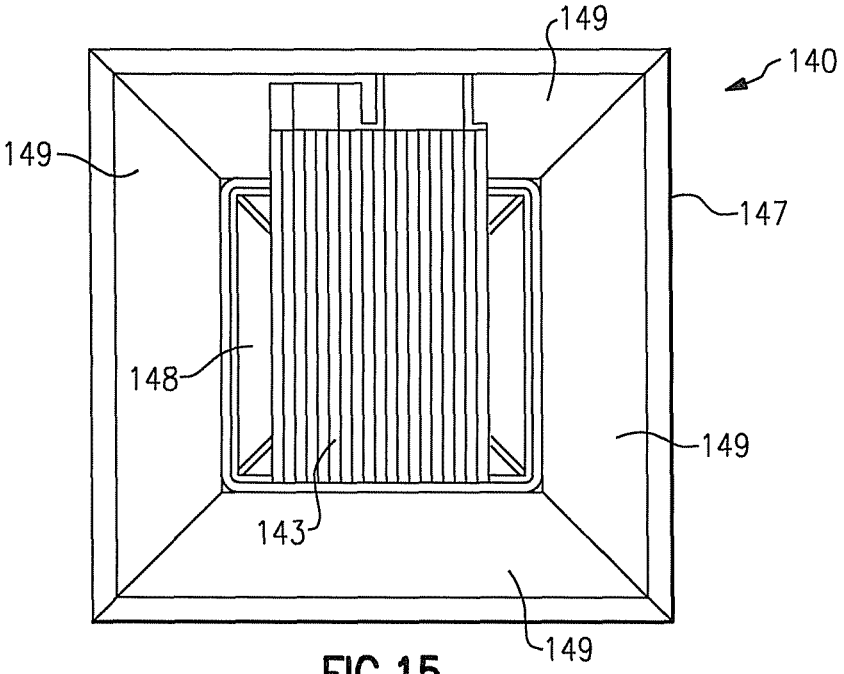

FIGS. 14 and 15 schematically depict a lighting device 140. FIG. 14 is a side view of the lighting device 140, and FIG. 15 is a top view of the lighting device 140.

Figure 16:
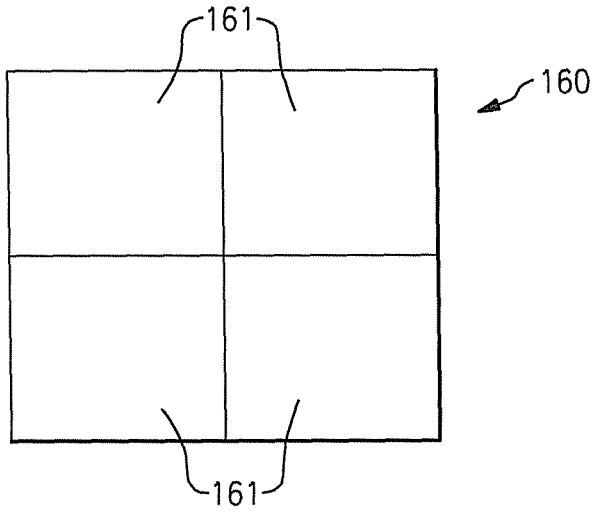

FIG. 16 depicts an optical device 160.

Figure 17:
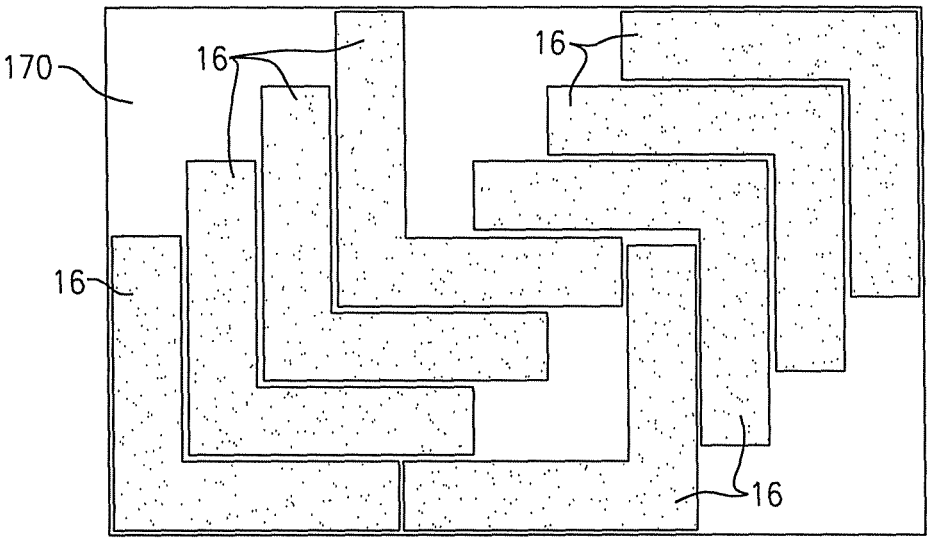

FIG. 17 depicts a layout for obtaining eight heat conductors 16 that can be used in the embodiment depicted in FIGS. 1-4.

DETAILED DESCRIPTION

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

All numerical quantities described herein are approximate and should not be deemed to be exact unless so stated.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top", "above," "horizontal" or "vertical" may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a light source, means that at least some current is being supplied to the light source to cause the light source to emit at least some electromagnetic radiation (e.g., visible light). The expression "illuminated" encompasses situations where the light source emits electromagnetic radiation continuously, or intermittently at a rate such that a human eye would perceive it as emitting electromagnetic radiation continuously or intermittently, or where a plurality of light sources of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting; specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

As noted above, some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one light source in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The expression "major surface" as used herein, means a surface which has a surface area which comprises at least 25% of the surface area of the entire structure, and in some cases at least 40% of the surface area of the entire structure (e.g., each of the top and bottom surfaces of a substantially flat thin structure having substantially parallel top and bottom surfaces).

The expression "thickness" as used herein with respect to a structure that has opposite major surfaces, means a minimum distance from a point on one major surface to a point on an opposite major surface.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly faunal sense unless expressly so defined herein. It will also be appreciated by those of skill in the art that references to a structure or feature that is disposed "adjacent" another feature may have portions that overlap or underlie the adjacent feature.

As noted above, some aspects of the present inventive subject matter provide lighting devices that comprise at least two light sources.

Persons of skill in the art are familiar with, and have ready access to, a wide variety of light sources that emit white light or that emit light of different hues, and any suitable light sources can be employed in accordance with the present inventive subject matter.

Representative examples of types of light sources include incandescent light sources, fluorescent light sources, solid state light emitters, laser diodes, thin film electroluminescent devices, light emitting polymers (LEPs), halogen lamps, high intensity discharge lamps, electron-stimulated luminescence lamps, etc., each with or without one or more filters. The at least two light sources can comprise two or more light sources of a particular type, or any combination of one or more light sources of each of two or more types.

As indicated above, some embodiments in accordance with the present inventive subject matter can comprise one or more solid state light emitters as one or more of the at least two light sources.

Persons of skill in the art are familiar with, and have ready access to, a wide variety of solid state light emitters, and any suitable solid state light emitter (or solid state light emitters) can be employed as one or more of the light sources in lighting devices according to the present inventive subject matter. A variety of solid state light emitters are well known. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise one or more solid state light emitters.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and lighting devices in accordance with the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package (also known as encapsulant) that encapsulates the light emitting diode.

Lighting devices according to the present inventive subject matter (and/or solid state light emitters in lighting devices that comprise one or more solid state light emitters) can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One or more luminescent materials (if included) can be provided in any suitable form. For example, luminescent material can be embedded in a resin (i.e., a polymeric matrix), such as a silicone material, an epoxy material, a glass material or a metal oxide material, and/or can be applied to one or more surfaces of a resin, to provide a lumiphor.

One or more solid state light emitters (if included) can be arranged in any suitable way.

In general, light of any number of hues can be mixed by the lighting devices according to the present inventive subject matter.

In some embodiments in accordance with the present inventive subject matter, there are provided lighting devices that comprise one or more substrates, on which one or more light sources can be mounted. Persons of skill in the art are familiar with a wide variety of materials (and combinations of materials) that a substrate can comprise, and any of such materials can be employed (in lighting devices that comprise one or more substrates). One or more substrates, if included, can individually be of any suitable shape and size.

In some embodiments in accordance with the present inventive subject matter that comprise one or more substrates, the substrate (or at least one of the substrates) can comprise a circuit board. Persons of skill in the art are familiar with a wide variety of types of circuit boards, and a wide variety of materials (and combinations of materials) that a circuit board can comprise, and any of such types and/or materials can be employed, as desired and as is suitable. For example, in some embodiments, a suitable circuit board can comprise a metal core printed circuit board.

In some embodiments in accordance with the present inventive subject matter, there is provided a lighting device that comprises two or more substrates, with at least a first light source mounted on at least two of the substrates. In some embodiments in accordance with the present inventive subject matter, there is provided a lighting device that comprises two or more substrates, with two or more light sources mounted on each of at least two of the substrates. In some embodiments, one or more light sources can be mounted directly on one or more reflective structures or other structures).

In some embodiments in accordance with the present inventive subject matter, there are provided lighting devices and fixture structures that comprise one or more reflective structures. Persons of skill in the art are familiar with a wide variety of materials (and combinations of materials) that a reflective structure can comprise, and any of such materials (and combinations of materials) can be employed. One or more reflective structures (if included) can be of any suitable shape and size. Representative examples of suitable materials that a reflective structure can comprise include metal (e.g., aluminum), MCPET® (foamed sheets made of extra-fine, foamed polyethylene terephthalate (PET) available from Furukawa Electric in Japan), and DLR. MCPET is further described in the data sheet entitled "*New Material for Illuminated Panels Microcellular Reflective Sheet MCPET*", by the Furukawa Electric Co., Ltd., updated Apr. 8, 2008, and in a publication entitled "*Furukawa America Debuts MCPET Reflective Sheets to Improve Clarity, Efficiency of Lighting Fixtures*", in *LED Magazine,* 23 May 2007, the disclosures of both of which are hereby incorporated herein by reference in their entirety as if set forth fully herein. DLR material is further described in a data sheet entitled "*DuPont™ Diffuse Light Reflector*", DuPont publication K-20044, May 2008, and is also described at diffuselight-reflector.dupont.com, the disclosure of both of which are hereby incorporated herein by reference in their entirety as if set forth fully herein. Other examples of reflective materials that can be used include WhiteOptics films (http://whiteoptics.com/?page_id=12), Valar from Genesis Plastics, Sabic BFL2000U or BFL4000U resin (95% reflective) and 3M ESR film (which are not microcellular and which use different methods to obtain high reflectivity).

In some embodiments, one or more reflective structures can comprise two or more structures, e.g., two or more layers, e.g., a reflective material (e.g., MCPET) on a second material (e.g., comprising metal, such as aluminum), that can for instance provide suitable mechanical, thermal and/or optical properties, e.g., structural rigidity and/or good heat conducting capabilities.

In some embodiments in accordance with the present inventive subject matter, there are provided lighting devices and fixture structures that comprise one or more heat conductors. Persons of skill in the art are familiar with a wide variety of materials (and combinations of materials) that a heat conductor can comprise, and any of such materials (and combinations of materials) can be employed. Representative examples of suitable materials that a heat conductor can comprise include graphite (e.g., graphite sheets from GrafTech) extruded aluminum, forged aluminum, copper, thermally conductive plastics or any other thermally conductive material. As used herein, a thermally conductive material refers to a material that has a thermal conductivity greater than air, e.g., at least about 1 W/(m K), in some cases at least about 10 W/(m K), and in some cases at least about 100 W/(m K).

One or more heat conductors (if included) can be of any suitable shape and size. One or more heat conductors can be in any suitable arrangement, e.g., they can cover any portion(s) or all of one or more reflective structures.

In some embodiments that comprise one or more heat conductors, at least a portion of at least one heat conductor can be elongated (i.e., have one dimension that is much larger than (e.g., at least three times as large, or at least five times or more as large) its dimension in the other two dimensions. For example, in the embodiment depicted in FIGS. 1-4, each of the heat conductors 16 is elongated (for example, referring to FIG. 3, the heat conductor 16 in the upper right (in the orientation depicted in FIG. 3) portion appears in the general shape of an "L", with the portion extending from the corner to the right, parallel to the page from the corner to the bend in the reflective structure 14 and thence at an angle (see FIG. 1) extending a distance (from the corner to the edge near the far edge of the reflective structure 14) that is much larger than its vertical dimension in the orientation depicted in FIG. 3 (and much larger, to an even greater extent, than its thickness (i.e., in the portion between the corner and the bend in the reflective structure 14, the dimension perpendicular to the plane of the page)), and the portion extending from the corner upward parallel to the page from the corner to the bend in the reflective structure 14 and thence at an angle (see FIG. 1) extending a distance (from the corner to the edge near the far edge of the reflective structure 14) that is much larger than its horizontal dimension in the orientation depicted in FIG. 3 (and much larger, to an even greater extent, than its thickness). In making a lighting device as depicted in FIGS. 1-4, there can be employed four heat conductors 16, each of which is generally "L-shaped", with a right-angled corner.

In some embodiments that comprise one or more heat conductors, (1) at least a portion of at least one heat conductor is between at least one light source and a reflective structure and/or (2) at least a portion of at least one reflective structure is between at least one light source and at least a portion of at least one heat conductor. For example, in the embodiment depicted in FIGS. 1-4, portions of the reflective structure 14 are between each of the four heat conductors 16 and each of the four clusters of solid state light emitters 12 and 13 (e.g., referring to the view seen in FIG. 1, of the heat conductor 16 that is visible in FIG. 1 to the right side, the leftmost portion (as visible in FIG. 1) is directly above the substrate 11 (that is visible in FIG. 1 to the right side), with a portion of the reflective structure 14 in between.

As noted above, some aspects of the present inventive subject matter provide lighting devices that comprise at least a first optical device.

An optical device (if included) can comprise any suitable material or materials, a wide variety of which are well known and available to persons of skill in the art. Representative examples of suitable materials that an optical device can comprise include macroporous materials, such as a low absorption diffusing material, e.g., microcellular polyethylene terephthalate (such as MCPET) or Diffuse Light Reflector (DLR) material. In some embodiments in accordance with the present inventive subject matter, a microcellular material (if included) can comprise cells of any suitable size, e.g., a mean cell diameter of less than about 10 micrometers. Other examples of materials that an optical device (if included) can comprise include WhiteOptics films (http://whiteoptics.com/?page_id=12), Valar from Genesis Plastics, Sabic BFL2000U or BFL4000U resin (95% reflective) and 3M ESR film (which are not microcellular and which use different methods to obtain high reflectivity). In some embodiments in accordance with the present inventive subject matter, a very thin layer of a material that can be used as a reflective material (e.g., MCPET, DLR or other materials described above) can be employed so that some light that impinges thereon passes through while some light that impinges thereon is reflected. In some embodiments in accordance with the present inventive subject matter, the thickness and/or particle size of a material that can be used as a reflective material (e.g., MCPET or DLR) can be selected (and/or one or more additional layers can be provided) to provide a specific transmittance-to-reflectance ratio (discussed in more detail below), and/or different regions can have specific thicknesses and/or particle sizes (and/or other features) so that the different regions have different specific transmittance-to-reflectance ratios.

An optical device (if included) can be of any suitable shape and size.

In some embodiments in accordance with the present inventive subject matter, an optical device (if included) can have light transmittance-to-reflectance ratios that differ at different locations. The expression "light transmittance-to-reflectance ratio" means, for a particular region of an optical device, a proportion of light that is transmitted through that region of the optical device, divided by a proportion of light that is reflected by that region of the optical device. In some embodiments in accordance with the present inventive subject matter, optical devices are provided which have desired relative values for transmittance-to-reflectance ratios at different locations, whereby the brightness of light emerging from different regions of the optical device is caused to be more uniform than would otherwise be the case (i.e., more uniform than would be the case if an optical device with substantially uniform transmittance-to-reflectance ratios were employed), and/or the brightness of light emerging from different regions of the optical device is caused to achieve at least a minimum quantifiable degree of uniformity. By way of example, referring to FIGS. 1 and 2, if the optical device 15 had a substantially uniform transmittance-to-reflectance ratio, the brightness of light emerging from the bottom (in the orientation depicted in FIG. 1) of the optical device 15 would be greater at locations directly beneath the clusters of light sources (i.e., directly beneath the substrates 11 with solid state light emitters 12 and 13 mounted on them) than at other locations on the bottom of the optical device 15. In some embodiments corresponding to FIGS. 1-4, the optical device 15 can have transmittance-to-reflectance ratios that differ at different locations, in particular, that are lower at locations directly beneath the clusters of light sources than at other locations on the bottom of the optical device 15, so that light emerging from the bottom of the optical device 15 is more uniform (or achieves a quantifiable degree of uniformity, e.g., light emitted from the solid state light emitters and emerging from each of at least 1000 non-overlapping conceptual square regions of the bottom of the optical device 15 has a brightness that is within 20 percent (and in some cases, within 15 percent, within 10 percent, within 7 percent or within 5 percent) of a particular brightness, each of the at least 1000 non-overlapping square regions comprising 0.08 percent of the total surface area of the bottom of the optical device 15.

In optical devices in which the transmittance-to-reflectance ratio differs in different regions, the transmittance-to-reflectance ratio can vary in any pattern, regular or irregular, repeating or non-repeating, e.g., linearly or geometrically.

In accordance with the present inventive subject matter, one or more optical devices (if included) can be provided with transmittance-to-reflectance ratios that differ at different locations in any of a variety of ways. As discussed below, different regions of an optical device can be caused to have different specific transmittance-to-reflectance ratios by causing different regions of one or more structures (e.g., a layer or layers) comprising a partially reflective/partially transmissive material to have different thicknesses, by causing different regions of one or more such structures to have different densities, by causing different regions of one or more such structures to have different average cell sizes, by providing a non-uniform array of holes (some or all of which extend entirely through the structure, and/or some or all of which extend only partially through the structure) in one or more structures, and/or by providing strips, dots or other regular or irregular pattern or patterns (repeating or non-repeating) on one or more structures. Adjusting a balance between an amount of light transmitted and an amount of light reflected may affect the number of bounces of light (i.e., the number of times photons are reflected) within a lighting device before the light exits the lighting device. Many aspects of the present inventive subject matter is counter-intuitive, in that at least some light that is emitted by one or more light sources is not allowed to exit the lighting device initially, and is instead reflected once or more times within the lighting device.

In some embodiments according to the present inventive subject matter, one or more optical devices (if included) can comprise a structure (or plural structures) that has regions of differing thickness (and that may comprise one or more holes and/or one or more reflective and/or diffusing particles), a diffusion element (or plural diffusion elements) (that may comprise one or more holes and/or one or more reflective and/or diffusing particles), and/or any other structure (that may comprise one or more holes and/or one or more reflective and/or diffusing particles).

As noted above, one way (that can be employed by itself or in combination with one or more other ways) to adjust the transmittance-to-reflectance ratio in one or more regions of an optical device can be to make the optical device thicker at regions for which a lower transmittance-to-reflectance is required or desired (e.g., if a material used to make an optical device is substantially uniform (whereby an optical device made of such a material and having a substantially uniform thickness would have a substantially uniform transmittance-to-reflectance ratio), the material could be provided at a larger thickness at specific regions in order to provide reduced transmittance-to-reflectance ratio at such regions). Persons of skill in the art can readily experiment with different thicknesses in order to arrive at optical devices that have specific desired transmittance-to-reflectance ratios at specific regions. Changes in thickness may be gradual or may be abrupt (or may satisfy any other characterization), and/or can be monotomic, symmetrical, non-monotonic, non-symmetrical, etc., or can follow any other pattern (or no pattern at all).

Differing thickness in a structure that an optical device comprises can be achieved by initially molding a structure with regions of differing thickness, and/or by abrading, scraping and/or otherwise selectively removing at least some material from a structure, and/or by selectively adding material to one or more regions.

As noted above, one way (that can be employed by itself or in combination with one or more other ways) to adjust the transmittance-to-reflectance ratio in one or more regions of an optical device can be to provide one or more holes in one or more structures. In embodiments in which a plurality of holes are provided, if desired, the holes can be arranged as a uniform or non-uniform array of holes. Any hole or holes provided in any structure can be of any suitable shape, e.g., they can have straight wall regions and/or non-straight wall regions, they can be of any suitable width, they can extend all the way through the structure or only part of the way through the structure, or any combination of such characteristics, and any such holes can be uniformly spaced or non-uniformly spaced within the structure (i.e., their packing density can differ in different regions of the structure, i.e., their packing density can be higher and/or their size can be larger where a higher transmittance-to-reflectance ratio is desired). In embodiments in which two or more structures that comprise holes are provided, some or all holes in the respective structures can be aligned, or none can be aligned, as desired. Holes can be provided in any suitable way (a wide variety of which is known to persons of skill in the art) by initially molding a structure with holes, and/or by otherwise selectively removing material in order to provide holes.

In some embodiments according to the present inventive subject matter, one or more optical devices (if included) can comprise at least a first patterned structure alone or in combination with any other structures as described herein. Any such patterned structure (or structures) can have any suitable regular or irregular pattern, and can be repeating or non-repeating. The elements in a patterned structure may be similar to one another or some or all may differ, and they can be of any suitable shape and size, e.g., a patterned structure may comprise an array of intersecting lines, an array of islands, such as dots or other features, etc. A patterned structure, if included, may be or may not be at least partially reflective. A patterned structure, if included, may be uniform in thickness, or it may vary in thickness, density, type of pattern, and/or material. A patterned structure, if included, can comprise any suitable arrangement of holes, if desired.

In some embodiments according to the present inventive subject matter, one or more optical devices (if included) can comprise one or more type of reflective and/or diffusing particles within or on any structure and/or within or on any of the other structures described herein. For example, an optical device that has transmittance-to-reflectance ratios that differ in different regions can be provided by providing a structure that has regions in which (and/or on which) reflective particles are provided in differing loadings (e.g., total particle volume per volume of region). Any such particles can be of any suitable sizes and/or shapes, and can comprise one type of material or two or more types of materials in any suitable arrangement. In some embodiments that comprise one or more type of reflective and/or diffusing particles (and/or particles that are both reflective and diffusing), such particles can be arranged as an array of reflective particles and/or diffusing particles (e.g., microlenses) on a structure and/or in a structure, which can be of different particle sizes and/or shapes, and/or which can be more densely populated in some regions than in others.

Persons of skill in the art can readily experiment with any suitable factors (including those described herein) that provide or contribute to altering transmittance-to-reflectance ratios in specific regions of structures, and combinations of such factors, to provide structures that have patterns of transmittance-to-reflectance ratios that are suitable for specific lighting devices.

In some embodiments in accordance with the present inventive subject matter, one or more optical devices (if included) can comprise one or more diffusion elements (e.g., one or more diffusion layers), alone or in addition to one or more other elements (e.g., alone or in addition to one or more elements that have light transmittance-to-reflectance ratios that differ in different regions). In some embodiments in accordance with the present inventive subject matter, one or more diffusion elements can be provided on one or more optical devices opposite one or more light sources (and/or between one or more light sources and one or more optical devices), so that at least some light that is emitted from the light source(s) emerges from the optical device(s) and impinges on the diffusion element(s) and emerges from the diffusion element(s). One or more diffusion elements can enhance uniformity of light color emitted by a lighting device (and/or can provide a quantifiable degree of uniformity of color of light emission, e.g., light emitted from one or more light sources emerging from each of at least 1000 non-overlapping conceptual square regions of a light exit surface have a color hue that is within 0.01 unit of a first color point on a 1976 CIE Chromaticity Diagram). In some situations, uniformity of emitted light color can be assessed based on whether or not the uniformity requirements of the L Prize are met.

Persons of skill in the art are familiar with a variety of materials and structures that can be used to provide diffusion elements. A diffusion element, if included, can be provided, for example, by a random array of light diffusing features, such as a randomly sized and/or spaced microlens array (e.g., as depicted in FIG. 13). For instance, a representative example of a suitable diffusion layer (if included) can be a Light Shaping Diffuser (LSD®), distributed by Liminit, which can provide 85%-92% transmission in a wide wavelength range of 360-1600 nm as described, for example, in a Liminit Datasheet entitled "*LED Lighting Applications*" and at the Liminit website at the IP address 216.154.222.249. Other representative examples of suitable low absorption diffusers, if included, can be one or more of the ADF series of diffusion films distributed by Fusion Optix, as described at fusionptix.com and in an article "*Lighting: Obscuration of LEDs*", diffusion films provided by ACEL, or diffusion films distributed by Bright View Technologies as described at brightviewtechologies.com.

In some embodiments in accordance with the present inventive subject matter, one or more optical devices (if included) can comprise one or more other elements to provide (or to assist in providing) any other desired properties, e.g., suitable mechanical, thermal and/or optical properties.

In some embodiments in accordance with the present inventive subject matter, one or more structures can be provided to enhance uniformity of brightness of light that emerges from a lighting device, and one or more other structures can be provided to enhance uniformity of color hue of light that emerges from a lighting device. It will be understood that any of such structures may act in part to enhance color hue uniformity and in part to enhance brightness uniformity. In some embodiments in accordance with the present inventive subject matter, however, a primary function of one or more structure is to enhance brightness uniformity, and/or a primary function of one or more other structures (e.g., one or more diffusion elements) is to enhance color uniformity.

Figure 7:
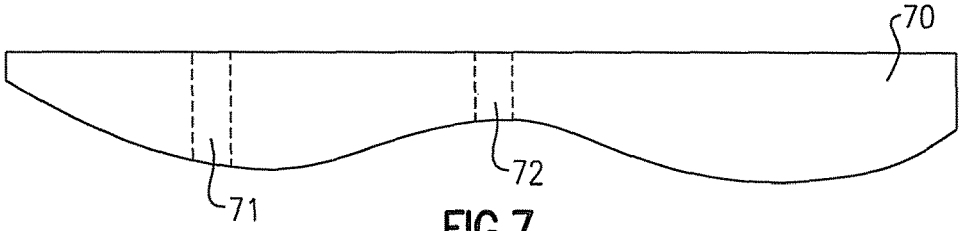
FIG. 7 is a schematic side view of an optical device 70 according to the present inventive subject matter.

FIG. 7 is a schematic side view of an optical device 70 according to the present inventive subject matter. Referring to FIG. 7, the optical device 70 has regions that are of differing thickness (e.g., the region 71 has a thickness that is larger that the thickness of the region 72).

In some embodiments according to the present inventive subject matter, one or more optical devices (if included) can comprise a structure similar to the optical device 70 (i.e., that has regions that are of differing thickness) alone or in combination with any other structures and/or features as described herein.

Figure 8:
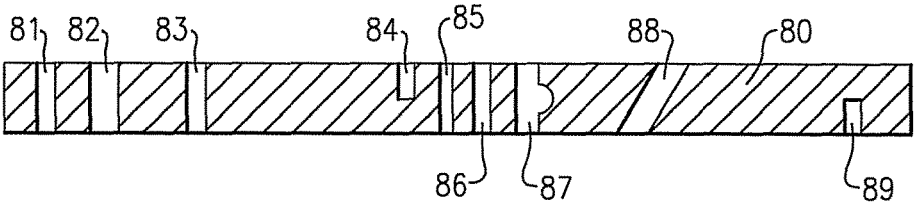
FIG. 8 is a schematic sectional side view of an optical device 80 according to the present inventive subject matter.

FIG. 8 is a schematic sectional side view of an optical device 80 according to the present inventive subject matter. Referring to FIG. 8, the optical device 80 has a plurality of holes (holes 81-89 being visible in FIG. 8). Any of the holes can be of any suitable shape, e.g., they can have straight wall regions and/or non-straight wall regions (holes 81-86, 88 and 89 have straight walls, hole 87 has a straight wall region and a non-straight wall region), they can be of any suitable width (hole 82 is wider than hole 85), they can extend all the way through the optical device or only part of the way through the optical device (holes 81-83 and 85-88 extend all the way through the optical device 80, whereas holes 84 and 89 extend only part of the way through the optical device 80), or any combination of such characteristics, and any such holes can be uniformly spaced or non-uniformly spaced (in the optical device 80, holes 84-88 are spaced more closely than holes 83 and 84).

In some embodiments according to the present inventive subject matter, one or more optical devices (if included) can comprise a structure similar to the optical device 80 (i.e., that has one or more holes) alone or in combination with any other structures and/or features as described herein.

Figure 9:
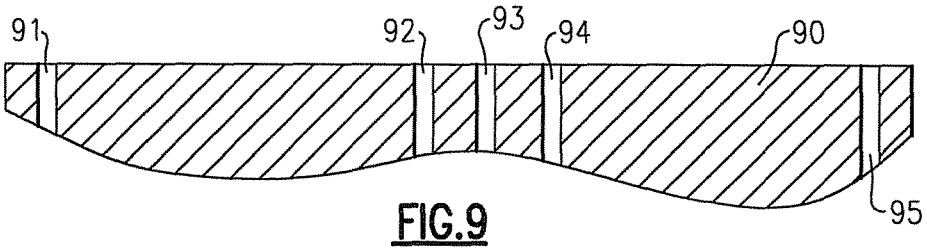
FIG. 9 is a schematic sectional side view of an optical device 90 according to the present inventive subject matter.

FIG. 9 is a schematic sectional side view of an optical device 90 according to the present inventive subject matter. Referring to FIG. 9, the optical device 90 incorporates features of the optical device 70 and the optical device 80, i.e., the optical device 90 has regions that are of differing thickness and it has holes 91-95.

In some embodiments according to the present inventive subject matter, one or more optical devices (if included) can comprise a structure similar to the optical device 90 (i.e., that has one or more holes) alone or in combination with any other structures and/or features as described herein.

Figure 10:
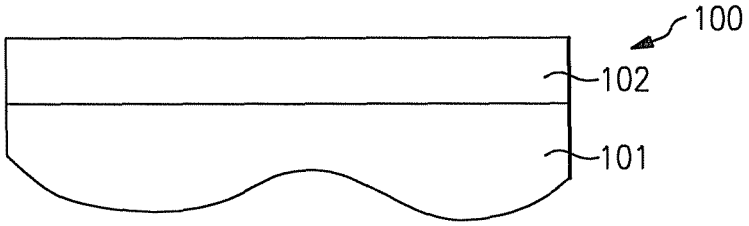
FIG. 10 is a schematic side view of an optical device 100 according to the present inventive subject matter.

FIG. 10 is a schematic side view of an optical device 100 according to the present inventive subject matter. The optical device 100 comprises a first structure 101 that has regions of differing transmittance-to-reflectance ratios (in this embodiment, due to varying thickness, but the differing transmittance-to-reflectance ratios could be provided in any way or combination of ways) and a diffusion element 102 of substantially uniform thickness.

Figure 11:
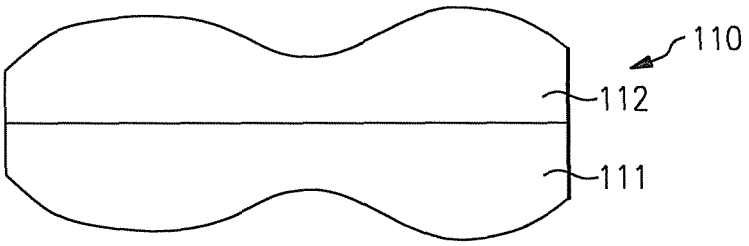
FIG. 11 is a schematic side view of an optical device 110 according to the present inventive subject matter.

FIG. 11 is a schematic side view of an optical device 110 according to the present inventive subject matter. Referring to FIG. 11, the optical device 110 is similar to the optical device 100, except that the optical device 110 comprises a diffusion element 112 that has regions of different thickness, in addition to a first structure 111 that has regions of differing transmittance-to-reflectance ratios. Alternatively, a diffusion element that has regions of different thicknesses could be combined with an optical device as depicted in FIG. 8 or FIG. 9, and/or holes could be provided in one or both of the first structure 111 and the diffusion element 112.

As noted above, in some embodiments according to the present inventive subject matter, one or more optical devices (if included) can comprise at least a first patterned structure alone or in combination with any other structures as described herein.

For example, FIG. 12 schematically depicts an optical device 120 that comprises a first structure 121 that has regions of differing transmittance-to-reflectance ratios (in this embodiment, due to varying thickness, but the differing transmittance-to-reflectance ratios could be provided in any way or combination of ways) and a patterned layer 122 on the first structure 121. The patterned layer 122 can be in any regular or irregular pattern (repeating or non-repeating), e.g., it may comprise an array of intersecting lines, an array of islands, such as dots or other features, etc. The patterned layer 122 may be at least partially reflective. The patterned layer 122 may be uniform in thickness, or it may vary in thickness, density, type of pattern, and/or material. If desired, one or more of the first structure 121 and the patterned layer 122 can comprise any suitable arrangement of holes. If desired, the first structure 121 and the patterned layer 122 can be reversed (i.e., instead of the first structure 121 being closer to one or more light sources, the patterned layer 122 can be closer to such light source(s)), and/or any suitable other structure or structures and/or features as described herein can be included.

As noted above, in some embodiments according to the present inventive subject matter, one or more optical devices (if included) can comprise one or more type of reflective and/or diffusing particles within or on any of the structures described herein.

For example, FIG. 13 is a schematic side view of an optical device 130 according to the present inventive subject matter. Referring to FIG. 13, the optical device 130 comprises a first structure 131 that has regions of differing transmittance-to-reflectance ratios (in this embodiment, due to varying thickness, but the differing transmittance-to-reflectance ratios could be provided in any way or combination of ways), a diffusion element 132 of substantially uniform thickness, and a plurality of reflective and/or diffusive particles 133 (e.g., microlenses) on a surface of the diffusion element 132 (alternatively or additionally, the particles 133 could be on the other surface of the diffusion element 132, in the diffusion element, in the first structure 131 and/or on one or more surfaces of the first structure 131). If desired, either or both of the first structure 131 and the diffusion element 132 could have any suitable arrangement of holes. If desired, the first structure 131 and the diffusion element 132 can be reversed (i.e., instead of the first structure 131 being closer to one or more light sources, the diffusion element 132 can be closer to such light source(s)), and/or any suitable number of other structures and/or layers can be included.

In some embodiments in accordance with the present inventive subject matter, an optical device (or any of two or more optical devices), if included, can comprise a single unitary structure or can comprise two or more optical device structures (that together make up part or an entirety of the optical device). In such embodiments, the optical device structures can be similar to each other, or any one or more of them can be different from any other optical device structure (or optical device structures).

For example, in some embodiments that comprise an optical device, the optical device can comprise a plurality of optical device structures that are tiled together, i.e., that are positioned so that their respective edges (regions between major surfaces) are in contact with one another. In such embodiments, two or more of the optical device structures can be attached to one another and/or held together in any suitable way. For instance, FIG. 16 depicts an optical device 160 that comprises four optical device structures 161 that are bonded to each other. If desired, the optical device 160 could be used in place of the optical device 15 in the embodiment depicted in FIGS. 1-4. In such a modified embodiment, each of the optical device structures could be similar, i.e., each with a region of lower transmittance-to-reflectance ratio in their center, beneath the respective substrates 11 with solid state light emitters 12 and 13, and with regions of progressively higher transmittance-to-reflectance ratio at larger distances from their center, whereby the brightness of light emitted can be made to satisfy specific desired uniformity characteristics. In like manner, other configurations can be provided, e.g., in repeating or non-repeating patterns where optical device structures are arranged to provide the effects needed to make uniform light emitted from corresponding with circuit boards (each having light sources mounted thereon) (e.g., optical device structures can be matched to each circuit board in an array of circuit boards, each having light sources mounted thereon, on a surface or surfaces, on e.g. a reflective structure).

Any of the features, structures and/or characteristics in any of FIGS. 7-13 can be combined in any suitable way in forming an optical device for use in embodiments according to the present inventive subject matter that comprise one or more optical devices.

As noted above, in some embodiments in accordance with the present inventive subject matter, there are provided lighting devices that comprise at least two light sources (any number of which can be, for example, solid state light emitters) and at least a first optical device that has at least a first light exit surface. In some of such embodiments, at least some of the light sources are clustered, and the first optical device is configured to enhance uniformity of light emitted from the light sources and emerging from the first light exit surface.

The expression "clustered", as used herein, means that at least some of the light sources are spaced closer to at least one other light source than would be the case if the light sources were evenly spaced across the entirety of a surface on which they are mounted. In some instances, "clustered" can encompass an arrangement in which two or more light sources are mounted on a surface, and a number of conceptual circular regions (equal to one third of the number of light sources) that together make up less than 50 percent of the area of the surface encompass at least 75 percent of the light sources (and in some cases, a number of circular regions, equal to one third of the number of light sources, that together make up less than 35 percent of the area of the surface encompass at least 90 percent of the light sources). In some instances, "clustered" can encompass an arrangement in which an average distance between each light source and its nearest neighboring light source is less than the value of (a surface area of the first light exit surface divided by a total number of light sources in the lighting device)$^{1/2}$, divided by two.

For example, in the embodiment depicted in FIGS. 1-4, four clusters are provided, each comprising a substrate 11, and five solid state light emitters 12 and 13. In the embodiment depicted in FIG. 5, nine clusters are provided (each comprising a substrate 51 and eight solid state light emitters (not shown). In the embodiment depicted in FIG. 6, eighteen clusters are provided (each comprising a substrate 61 and three solid state light emitters (not shown).

As noted above, in some embodiments in accordance with the present inventive subject matter, there are provided lighting devices that comprise at least two light sources and at least a first optical device that has at least a first light exit surface. In some of such embodiments, at least some of the light sources are clustered, and light emitted from at least the first and second solid state light emitters and emerging from the first light exit surface has good uniformity of color hue and/or good uniformity of brightness.

The expression "good uniformity of color hue", as used herein, can indicate that when light sources emit light, each of at least 1000 non-overlapping conceptual square regions (not physically defined, but instead defined by imaginary lines) of the first light exit surface have a color hue that is within 0.01 unit of a first color point on a 1976 CIE Chromaticity Diagram (each of the at least 1000 non-overlapping square regions comprising 0.08 percent of a total surface area of the first light exit surface). In some situations, "good uniformity of color hue" (and/or "good uniformity of emitted light color") can be assessed based on whether or not the color hue uniformity requirements of the L Prize are met.

The expression "good uniformity of brightness", as used herein, can indicate that when light sources emit light, each of at least 1000 non-overlapping conceptual square regions (again, not physically defined, but instead defined by imaginary lines) of the first light exit surface have a brightness that is within 5 percent of a first brightness (each of the at least 1000 non-overlapping square regions comprising 0.08 percent of a total surface area of the first light exit surface).

As noted above, in some embodiments in accordance with the present inventive subject matter, there are provided fixture structures that comprise at least a first reflective structure and at least a first heat conductor that is in contact with the first reflective structure. In some of such embodiments, the heat conductor(s) covers not more than 30 percent (in some cases not more than 20 percent, and in some cases not more than 10 percent) of a total surface area of the first reflective structure, and/or the first heat conductor has anisotropic heat conductivity (e.g., it has a first heat conductivity in a first direction and a second heat conductivity in a second direction, the first heat conductivity at least twice the second heat conductivity).

Some embodiments in accordance with the present inventive subject matter can comprise a power supply (which can comprise one or more power supply elements) or one or more power supply elements. Any such power supply or power supply element(s) (if included) can be located in any suitable place.

In some embodiments in accordance with the present inventive subject matter that comprise a power supply (or at least a first power supply element), a power supply (or a power supply element) can comprise any electronic component (or components) that are suitable for a lighting device, for example, any of (1) one or more electrical components employed in converting electrical power (e.g., from AC to DC and/or from one voltage to another voltage), (2) one or more electronic components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in input power (e.g., a dimming signal in AC power supplied to the lighting device), etc., (3) one or more circuit boards (e.g., a metal core circuit board) for supporting and/or providing current to any electrical components, and/or (4) one or more wires connecting any components (e.g., connecting an Edison socket to a circuit board), etc., e.g. electronic components such as linear current regulated supplies, pulse width modulated current and/or voltage regulated supplies, bridge rectifiers, transformers, power factor controllers, etc.

For example, solid state lighting systems have been developed that include a power supply that receives AC line voltage and converts that voltage to a voltage (e.g., to DC and to a different voltage value) and/or current suitable for driving solid state light emitters. Power supplies as discussed above can be employed.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg Johansen, U.S. Pat. No. 7,202,608 to Robinson et al, U.S. Pat. Nos. 6,995,518, 6,724,376, 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In some embodiments that comprise two or more light sources, any such light sources can emit light of a same or similar color hue, and/or at least one light source can emit light of a color hue that is spaced from the color hue of light emitted by a second light source by at least 0.1 unit on a 1976 CIE Chromaticity Diagram.

For instance, some embodiments according to the present inventive subject matter can comprise at least one solid state light emitter that, if energized, emits BSY light, and at least one solid state light emitter that, if energized, emits light that is not BSY light.

The expression "BSY light", as used herein, means light having x, y color coordinates which define a point which is within (1) an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53

In some embodiments according to the present inventive subject matter, when the lighting device is energized, a mixture of light emitted by the light sources in the lighting device is within about 10 MacAdam ellipses of the blackbody locus on a 1931 CIE Chromaticity Diagram. In some of such embodiments:

(1) at least one solid state light emitter that, if energized, emits light that is not BSY light emits light that has a dominant wavelength in the range of from about 600 nm to about 630 nm, and/or (2) at least one solid state light emitter that, if energized, emits BSY light comprises a first group of at least one light emitting diode, the at least one solid state light emitter that, if energized, emits light that is not BSY light comprises a second group of at least one light emitting diode, the first and second groups of light emitting diodes are mounted on at least one circuit board, and an average distance between a center of each light emitting diode in the first group and a closest point on an edge of the circuit board on which that light emitting diode is mounted is smaller than an average distance between a center of each light emitting diode in the second group and a closest point on an edge of the circuit board on which that light emitting diode is mounted.

In some embodiments in accordance with the present inventive subject matter, an optical device (or two or more optical devices), if included, can have a total light absorption of any suitable value, e.g., not greater than 15 percent, not greater than 10 percent, not greater than 4 percent, etc. "Total light absorption," as used herein in connection with an optical device (or optical devices), means the percentage of light emitted by one or more light sources (e.g., in a lighting device) that at some point (e.g., before being reflected or after being reflected one or more times) enters but does not exit the optical device(s).

In some embodiments according to the present inventive subject matter, solid state light emitters can be electrically arranged in series with enough solid state light emitters present to match (or to come close to matching) the voltage supplied to the solid state light emitters (e.g., in some embodiments, the DC voltage obtained by rectifying line AC current and supplying it to the solid state light emitters via a power supply). For instance, in some embodiments, sixty-eight solid state light emitters (or other numbers, as needed to match the line voltage) can be arranged in series, so that the voltage drop across the entire series is about 162 volts. Providing such matching can help provide power supply efficiencies and thereby boost the overall efficiency of the lighting device. In such lighting devices, total lumen output can be regulated by adjusting the current supplied to the series of solid state light emitters.

In some embodiments in accordance with the present inventive subject matter, one or more scattering elements (e.g., layers) can optionally be included in lighting devices according to the present inventive subject matter. A scattering element, if included, can be included in an optical device, and/or a separate scattering element can be provided. A wide variety of scattering elements are well known to those of skill in the art, and any such elements can be employed in the lighting devices of the present inventive subject matter.

Some embodiments in accordance with the present inventive subject matter can comprise one or more electrical connector. Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (which are receivable in Edison sockets) and GU24 pins (which are receivable in GU24 sockets).

Any desired circuitry (including any desired electronic components) can be employed in devices according to the present inventive subject matter (e.g., in order to supply energy to one or more light sources).

In some embodiments of lighting devices according to the present inventive subject matter, the lighting device can be a self-ballasted device. For example, some embodiments provide a lighting device that can be directly connected to AC current (e.g., by being plugged into a wall receptacle, by being screwed into an Edison socket, by being hard-wired into a branch circuit, etc.).

Some embodiments of lighting devices in accordance with the present inventive subject matter can comprise a power line that can be connected to a source of power (such as a branch circuit, a battery, a photovoltaic collector, etc.) and that can supply power to an electrical connector (or directly to one or more light source(s)). Persons of skill in the art are familiar with, and have ready access to, a variety of structures that can be used as a power line. A power line can be any structure that can carry electrical energy and supply it to an electrical connector on a fixture structure and/or to a lighting device according to the present inventive subject matter.

Embodiments in accordance with the present inventive subject matter can comprise any additional component(s) and/or feature(s) to assist in providing heat dissipation, e.g., suitable heat sink, heat transfer and/or heat dissipation component(s) and/or feature(s). Persons of skill in the art are familiar with a wide variety of heat sink, heat transfer and/or heat dissipation component(s) and/or feature(s), e.g., to provide passive cooling and/or active cooling (i.e., cooling that requires energy to operate, e.g., fans, etc.), and any of these can be employed, as suitable.

In some embodiments of the present inventive subject matter, one or more phase change cooling devices can be provided (e.g., thermally coupled to one or more heat conductors and/or to one or more reflective structures). Any such phase change cooling device can be an active cooling device or a passive cooling device. For instance, an example of a passive phase change cooling device is a heat pipe. In embodiments that include one or more heat pipe(s), for each heat pipe, a first end of the heat pipe can be thermally coupled to a heat dissipation structure (e.g., to one or more heat conductors and/or to one or more reflective structures), e.g., to a location on a structure from which heat needs to be extracted, such as a particularly hot spot that is near a cluster of solid state light emitters, and the other end of the heat pipe can be suspended in air (whereby at the first end, heat from the structure from which heat is being extracted converts liquid within the heat pipe into gas, the gas flows toward the second end of the heat pipe, heat is dissipated along the length of the heat pipe, and the gas condenses somewhere along the length of the heat pipe between the first end and the second end, and the condensed gas again flows to the first end, where it is again converted back to gas). An example of an active phase change cooling device is a refrigeration cycle, where the heat extraction portion of the cycle is used to extract heat from the structure from which heat is being extracted.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters.

Energy can be supplied to lighting devices according to the present inventive subject matter from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

The present inventive subject matter is also directed to lighting devices that may further comprise a fixture element (e.g., in which the lighting device is electrically connected to a fixture element, such as by an Edison plug being threaded in an Edison socket on the fixture element). A fixture element (if included) can comprise a housing, a mounting structure, and/or an enclosing structure. Persons of skill in the art are familiar with, and can envision, a wide variety of materials out of which a fixture element, a housing, a mounting structure and/or an enclosing structure can be constructed, and a wide variety of shapes for such a fixture element, a housing, a mounting structure and/or an enclosing structure. A fixture element, a housing, a mounting structure and/or an enclosing structure made of any of such materials and having any of such shapes can be employed in accordance with the present inventive subject matter.

In some embodiments, lighting devices according to the present inventive subject matter can further comprise elements that help to ensure that the perceived color (including color temperature) of light exiting the lighting device is accurate (e.g., within a specific tolerance). A wide variety of such elements and combinations of elements are known, and any of them can be employed in lighting devices according to the present inventive subject matter.

Some embodiments in accordance with the present inventive subject matter can comprise a controller configured to control a ratio of emitted light of at least a first color point (or range of color points) and emitted light of a second color (or range of colors) such that a combination of emitted light is within a desired area on a CIE Chromaticity Diagram.

Persons of skill in the art are familiar with, have access to, and can readily envision a variety of suitable controllers that can be used to control the above ratio, and any of such controllers can be employed in accordance with the present inventive subject matter.

A controller, if included, may be a digital controller, an analog controller or a combination of digital and analog. For example, a controller may be an application specific integrated circuit (ASIC), a microprocessor, a microcontroller, a collection of discrete components or combinations thereof. In some embodiments, a controller may be programmed to control light sources. In some embodiments, control of the light sources may be provided by the circuit design of the controller and can therefore be fixed at the time of manufacture. In still further embodiments, aspects of the controller circuit, such as reference voltages, resistance values or the like, may be set at the time of manufacture so as to allow adjustment of the control of light sources without the need for programming or control code.

In some embodiments, there is provided drive circuitry that comprises a power supply and drive controller that allows for separate control of at least two strings of LEDs, and in some embodiments, at least three strings of LEDs. Providing separate drive control can allow for adjusting string currents to tune the color point of the LEDs combined light output.

In some embodiments of the present inventive subject matter, a set of parallel solid state light emitter strings (i.e., two or more strings of solid state light emitters arranged in parallel with each other) can be arranged in series with a power line, such that current is supplied through the power line to each of the respective strings of solid state light emitters. The expression "string", as used herein, means that at least two solid state light emitters are electrically connected in series. In some such embodiments, the relative quantities of solid state light emitters in the respective strings differ from one string to the next, e.g., a first string contains a first percentage of solid state light emitters that emit BSY light and a second string contains a second percentage (different from the first percentage) of solid state light emitters that emit BSY light. As a representative example, first and second strings each contain solely (i.e., 100%) solid state light emitters that emit BSY light, and a third string contains 50% solid state light emitters that emit BSY light and 50% solid state light emitters that emit non-BSY light, e.g., red light (each of the three strings electrically connected in parallel to each other and in series with a common power line). By doing so, it is possible to easily adjust the relative intensities of the light of the respective wavelengths, and thereby effectively navigate within the CIE Diagram and/or compensate for other changes. For example, the intensity of non-BSY light can be increased, when necessary, in order to compensate for any reduction of the intensity of the light generated by the solid state light emitters that emit non-BSY light. Thus, for instance, in the representative example described above, by increasing or decreasing the current supplied to the third power line, and/or by increasing or decreasing the current supplied to the first power line and/or the second power line (and/or by intermittently interrupting the supply of power to the first power line or the second power line), the x, y coordinates of the mixture of light emitted from the lighting device can be appropriately adjusted.

Alternatively, in some embodiments, drive circuitry can be provided which comprises a power supply and single string LED controller. Such an arrangement may reduce cost and size of the drive circuitry.

In some embodiments, drive circuitry can be provided to achieve some degree of power factor correction. In some embodiments, there can be provided a lighting device that may have a power factor of greater than 0.7 and in some embodiments a power factor of greater than 0.9. In some embodiments, a lighting device can have a power factor of greater than 0.5. Such embodiments may not require power factor correction and, therefore, may be less costly and smaller in size. Additionally, drive circuitry may be provided for dimming a lighting device.

As noted above, light sources, such as solid state light emitters (and any luminescent material), if included, can be arranged in any desired pattern. In the embodiment depicted in FIGS. 1-4, for example, five solid state light emitters are on each circuit board, with four BSY solid state light emitters in corner positions and a red solid state light emitter in the middle position.

As noted above, some embodiments according to the present inventive subject matter can include solid state light emitters that emit light of a first hue (e.g., light that is not BSY light, for example, red or reddish or reddish orange or orangish, or orange light) and solid state light emitters that emit light of a second hue (e.g., BSY light), where each of the solid state light emitters that emit light of the first hue is surrounded by five or six solid state light emitters that emit light of the second hue.

In some embodiments, solid state light emitters (e.g., where a first group includes solid state light emitters that emit light of a first hue, e.g., non-BSY light, for example, red, reddish, reddish-orange, orangish or orange light, and a second group includes solid state light emitters that emit light of a second hue (e.g., BSY light) may be arranged pursuant to a guideline described below in paragraphs (1)-(5), or any combination of two or more thereof, to promote mixing of light from light sources emitting different colors of light:

(1) an array that has groups of first and second solid state light emitters with the first group of solid state light emitters arranged so that no two of the first group solid state light emitters are directly next to one another in the array;

(2) an array that comprises a first group of solid state light emitters and one or more additional groups of solid state light emitters, the first group of solid state light emitters arranged so that at least three solid state light emitters from the one or more additional groups is adjacent each of the solid state light emitters in the first group;

(3) an array is mounted on a submount, and the array comprises a first group of solid state light emitters and one or more additional groups of solid state light emitters, and (c) the array is arranged so that less than fifty percent (50%), or as few as possible, of the solid state light emitters in the first group of solid state light emitters are on the perimeter of the array;

(4) an array comprises a first group of solid state light emitters and one or more additional groups of solid state light emitters, and the first group of solid state light emitters is arranged so that no two solid state light emitters from the first group are directly next to one another in the array, and so that at least three solid state light emitters from the one or more additional groups is adjacent each of the solid state light emitters in the first group; and/or (5) an array is arranged so that no two solid state light emitters from the first group are directly next to one another in the array, fewer than fifty percent (50%) of the solid state light emitters in the first group of solid state light emitters are on the perimeter of the array, and at least three solid state light emitters from the one or more additional groups is adjacent each of the solid state light emitters in the first group.

Arrays according to the present inventive subject matter can also be arranged other ways, and can have additional features, that promote color mixing.

Figure 1:
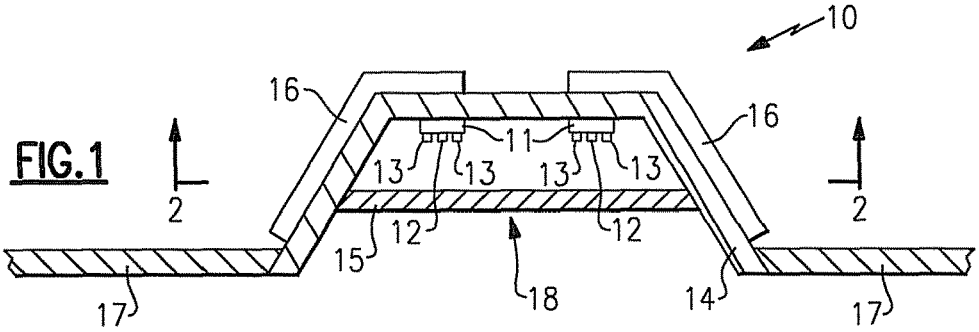

Solid state light emitters may be provided in an arrangement as shown in FIG. 1 or may be provided in other configurations. For example, there can be provided a roughly circular, triangular or square array or even a single packaged device having one or more LEDs, such as an MC device from Cree, Inc., or in any pattern as described above (including, among other arrangements, where each solid state light emitter that emits light in one hue is surrounded by five or six solid state light emitters that emit light in another hue, or in accordance with any of guidelines (1)-(5) described above).

While not illustrated in the figures, to the extent that two components are to be thermally coupled together, thermal interface materials may also be provided. For example, at any such interface, a thermal interface gasket, thermal grease, or any other suitable thermal interface material (a variety of which are well known to those of skill in the art) may be used to improve the thermal connection between the two components.

In some aspects of the present inventive subject matter, which can include or not include any of the features described elsewhere herein, there are provided lighting devices that provide sufficient lumen output (to be useful as a replacement for a conventional lamp), that provide good efficiency and that are within the size and shape constraints of the lighting device for which they are a replacement. In some cases, "sufficient lumen output" means at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

In some embodiments of this type, there are provided lighting devices that provide lumen output of any specific quantity, e.g., at least 2,000 lumens, and in some embodiments at least 3,000 lumens, at least 4,000 lumens, or more.

In some aspects of the present inventive subject matter, which can include or not include any of the features described elsewhere herein, there are provided lighting devices that are within the size and shape constraints of the lamp for which the lighting device is a replacement.

In some aspects of the present inventive subject matter, which can include or not include any of the features described elsewhere herein, there are provided lighting devices that provide CRI Ra of at least 70, and in some embodiments at least 80, at least 85, at least 90 or at least 95.

In some aspects of the present inventive subject matter, which can include or not include any of the features described elsewhere herein, there are provided lighting devices that provide wall plug efficiency of at least 60 lumens per Watt (and in some aspects, in some aspects at least 70 lumens per Watt, in some aspects at least 80 lumens per Watt, in some aspects at least 90 lumens per Watt, in some aspects at least 95 lumens per Watt, and in some aspects at least 100 lumens per Watt or at least 104 lumens per Watt).

The expression "wall plug efficiency", as used herein, is measured in lumens per Watt, and means lumens exiting a lighting device, divided by all energy supplied to create the light, as opposed to values for individual components and/or assemblies of components. Accordingly, wall plug efficiency, as used herein, accounts for all losses, including, among others, any quantum losses, i.e., losses generated in converting line voltage into current supplied to light emitters, the ratio of the number of photons emitted by luminescent material(s) divided by the number of photons absorbed by the luminescent material(s), any Stokes losses, i.e., losses due to the change in frequency involved in the absorption of light and the re-emission of visible light (e.g., by luminescent material(s)), and any optical losses involved in the light emitted by a component of the lighting device actually exiting the lighting device. In some embodiments, lighting devices in accordance with the present inventive subject matter provide the wall plug efficiencies specified herein when they are supplied with AC power (i.e., where the AC power is converted to DC power before being supplied to some or all components, the lighting device also experiences losses from such conversion), e.g., AC line voltage. The expression "line voltage" is used in accordance with its well known usage to refer to electricity supplied by an energy source, e.g., electricity supplied from a grid, including AC and DC.

In some aspects of the present inventive subject matter, which can include or not include any of the features described elsewhere herein, there are provided lighting devices that can direct light in any desired range of directions. For instance, in some embodiments, a lighting device can direct light substantially hemispherically (i.e., in all directions to one side of a plane, e.g., a plane define by a surface at which light from the lighting device is emitted) or substantially omnidirectionally (i.e., substantially 100% of all directions extending from a center of the lighting device), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lighting device). In some embodiments, a lighting device can emit light substantially in all directions within a volume defined by a two-dimensional shape in an x, y plane that encompasses rays extending from 0 degrees to 150 degrees relative to the y axis (extending along a vertical axis of the lighting device), the two-dimensional shape being rotated 360 degrees about the y axis. In some embodiments, a lighting device emits light substantially in all directions within a volume defined by a two-dimensional shape in an x, y plane that encompasses rays extending from 0 degrees to 120 degrees relative to the y axis (extending along a vertical axis of the lighting device), the two-dimensional shape being rotated 360 degrees about the y axis. In some embodiments, a lighting device can emit light substantially in all directions within a volume defined by a two-dimensional shape in an x, y plane that encompasses rays extending from 0 degrees to 90 degrees relative to the y axis (extending along a vertical axis of the lighting device), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which a lighting device emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, a lighting device can emit light in at least 50% of all directions extending from a center of the lighting device (e.g., hemispherical being 50%), and in some embodiments at least 60%, 70%, 80%, 90% or more.

In some embodiments, which may include or not include any other feature described herein, a lighting device may have a light output that is substantially symmetric axially, e.g., of from about 0° to about 150° axially symmetric.

In some aspects of the present inventive subject matter, which can include or not include any of the features described elsewhere herein, there are provided lighting devices that can emit light of generally any desired CCT or within any desired range of CCT. In some embodiments, there are provided lighting devices that emit light having a correlated color temperature (CCT) of between about 2500K and about 4000K. In some embodiments, the CCT may be as defined in the Energy Star Requirements for Solid State Luminaires, Version 1.1, promulgated by the United States Department of Energy.

In some embodiments, there are provided lighting devices that emit light that has a correlated color temperature (CCT) of about 2700K and that has x, y color coordinates that define a point which is within an area on a 1931 CIE Chromaticity Diagram defined by points having x, y coordinates of (0.4578, 0.4101), (0.4813, 0.4319), (0.4562, 0.4260), (0.4373, 0.3893), and (0.4593, 0.3944).

In some embodiments, there are provided lighting devices that emit light that has a correlated color temperature (CCT) of about 3000K and that has x, y color coordinates that define a point which is within an area on a 1931 CIE Chromaticity Diagram defined by points having x, y coordinates of (0.4338, 0.4030), (0.4562, 0.4260), (0.4299, 0.4165), (0.4147, 0.3814), and (0.4373, 0.3893).

In some embodiments, there are provided lighting devices that emit light that has a correlated color temperature (CCT) of about 3500K and that has x, y color coordinates that define a point which is within an area on a 1931 CIE Chromaticity Diagram defined by points having x, y coordinates of (0.4073, 0.3930), (0.4299, 0.4165), (0.3996, 0.4015), (0.3889, 0.3690), (0.4147, 0.3814).

Solid state light emitter lifetime (and/or lighting device lifetime) is typically measured by an "L70 lifetime", i.e., a number of operational hours in which the light output of a light emitter (or a lighting device) (and therefore also the wall plug efficiency) does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments are described herein with reference to "expected L70 lifetime." Because the lifetimes of solid state lighting products are measured in the tens of thousands of hours, it is generally impractical to perform full term testing to measure the lifetime of the product. Therefore, projections of lifetime from test data on the system and/or light source are often used to project the lifetime of the system. Such testing methods include, but are not limited to, the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

In some aspects of the present inventive subject matter, which can include or not include any of the features described elsewhere herein, there are provided lighting devices) that can provide an expected L70 lifetime of at least 25,000 hours. Lighting devices according to some embodiments of the present inventive subject matter can provide expected L70 lifetimes of at least 35,000 hours, and lighting devices according to some embodiments of the present inventive subject matter can provide expected L70 lifetimes of at least 50,000 hours.

In some aspects of the present inventive subject matter, which can include or not include any of the features described elsewhere herein, there are provided lighting devices that provide good heat dissipation (e.g., in some embodiments, sufficient that the lighting device can continue to provide at least 70% of its initial wall plug efficiency for at least 25,000 hours of operation of the lighting device, and in some cases for at least 35,000 hours or 50,000 hours of operation of the lighting device).

The expression "thermal equilibrium", as used herein, refers to supplying current to one or more light sources in a lighting device to allow the light source(s) and other surrounding structures to heat up to (or near to) a temperature to which they will typically be heated when the lighting device is energized. The particular duration that current should be supplied will depend on the particular configuration of the lighting device. For example, the greater the thermal mass, the longer it will take for the light source(s) to approach their thermal equilibrium operating temperature. While a specific time for operating a lighting device prior to reaching thermal equilibrium may be lighting device-specific, in some embodiments, durations of from about 1 to about 60 minutes or more and, in specific embodiments, about 30 minutes, may be used. In some instances, thermal equilibrium is reached when the temperature of the light source (or each of the light sources) does not vary substantially (e.g., more than 2 degrees C.) for at least 15 minutes without a change in ambient or operating conditions.

In many situations, the lifetime of light sources, e.g., solid state light emitters, can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of a thermal management system of a lighting device is/are selected so as to dissipate heat at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value)).

In some instances, color output can be analyzed while the light emitters (or the entire lighting device) are at ambient temperature, e.g., substantially immediately after the light emitter (or light emitters, or the entire lighting device) is illuminated. The expression "at ambient temperature", as used herein, means that the light emitter(s) is within 2 degrees C. of the ambient temperature. As will be appreciated by those of skill in the art, the "ambient temperature" measurement may be taken by measuring the light output of the device in the first few milliseconds or microseconds after the device is energized.

In light of the above discussion, in some embodiments, light output characteristics, such as lumen output, chromaticity (correlated color temperature (CCT)) and/or color rendering index (CRI) are measured with the solid state light emitters, such as LEDs, at thermal equilibrium. In other embodiments, light output characteristics, such as lumens, CCT and/or CRI are measured with the solid state light emitters at ambient temperature. Accordingly, references to lumen output, CCT or CRI describe some embodiments where the light characteristics are measured with the solid state light emitters at thermal equilibrium and other embodiments where the light characteristics are measured with the solid state light emitters at ambient temperature.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

FIGS. 1-4 depict a lighting device 10 according to the present inventive subject matter. Referring to FIGS. 1-4, the lighting device 10 comprises four substrates 11, a plurality of solid state light emitters 12 and 13 mounted on each of the substrates 11, a reflective structure 14, an optical device 15 and four heat conductors 16. The solid state light emitters 12 and 13 can each emit light of the same color hue, or one or more solid state light emitters can emit light of one color, and one or more solid state light emitters can emit light of at least one other color. For example, in some embodiments, each solid state light emitter 12 on each substrate 11 can emit red light and each solid state light emitter 13 on each substrate 11 can emit BSY light. In some embodiments, one or more of the substrates 11 can comprise a circuit board (e.g., a metal core printed circuit board). The arrangement depicted in FIGS. 1-4 is suitable for a lighting device that can be mounted in a space formed in a construction surface, e.g., a ceiling 17 that measures, for example, two feet by two feet (or other dimensions).

As shown in FIGS. 1-4, the solid state light emitters on each substrate 11 are clustered (i.e., the lighting device 10 comprises four clusters). As a result, the colors of light from the solid state light emitters in each cluster is mixed well (due to the close proximity of each of the solid state light emitters in each cluster), but the brightness of light is concentrated beneath (in the orientation depicted in FIG. 1) each cluster. The optical device 15 makes the brightness of light more uniform across the exit surface 18 of the optical device 15. The optical device can also provide diffusion properties to make the light color even more uniform across the exit surface 18.

The heat conductors 16 help to move the heat from hot spots (substantially square regions directly above (in the orientation shown in FIG. 1) each of the four substrates 11) to different regions of the reflective structure 14, from which it can be dissipated (including part of the reflective structure 14 which is exposed to room air, i.e., air beneath the ceiling 17 and/or beneath the optical device 15. In the embodiment depicted in FIGS. 1-4, the heat conductors 16 are on the outside surface of the reflective structure 14 (i.e., the heat conductors 16 are separated from the substrates 11 by the reflective structure 14)—alternatively or additionally, one or more of the heat conductors 16 can be on the inside surface of the reflective structure 14 (i.e., portions of the heat conductors 16 can be between the substrate(s) 11 and the reflective structure 14, and/or one or more heat conductors can be embedded within the reflective structure 14.

Figure 4:
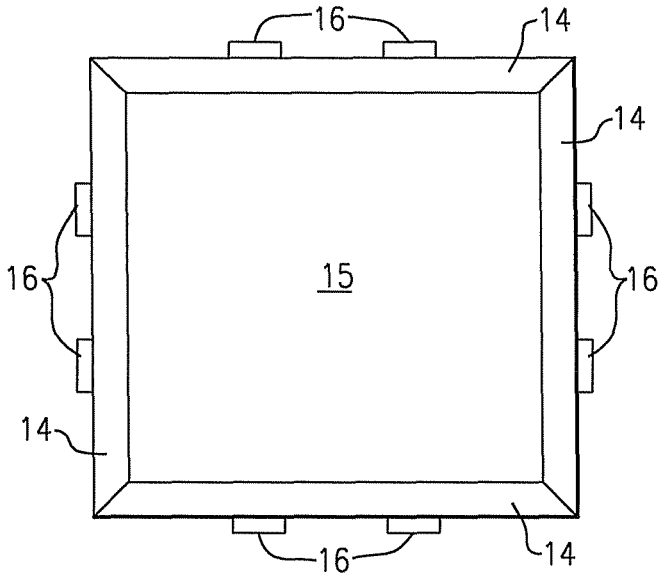

Referring to FIG. 4, the total number of light sources in the lighting device (i.e., twenty) are within a space defined by the reflective structure 14 and the optical device 15.

In accordance with another aspect of the present inventive subject matter, one or more heat conductors can be shaped and/or can be obtained from a supply of material used to make the heat conductor(s) in such a way that the amount of the supply of material that is wasted can be reduced or minimized, while still providing favorable properties for the heat conductor(s) (e.g., a heat conductor is an integral piece obtained from the supply of material). For example, FIG. 17 depicts a layout for obtaining eight heat conductors 16 that can be used in the embodiment depicted in FIGS. 1-4, in which the amount of material from a rectangular piece 170 of supply material is reduced in comparison to other possible layouts (i.e., the heat conductor geometry and layout, and the nesting of the heat conductors in the layout allows for low material waste in a die-cut sheet system). In some embodiments, the piece 170 of supply material has anisotropic heat conductivity properties that are favorably aligned in the longer directions that the heat conductors 16 extend.

Figure 2:
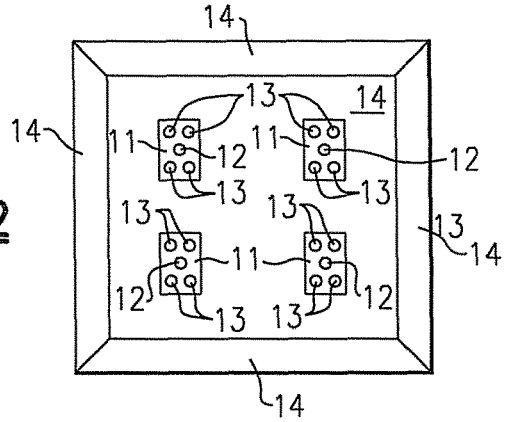
Figure 3:
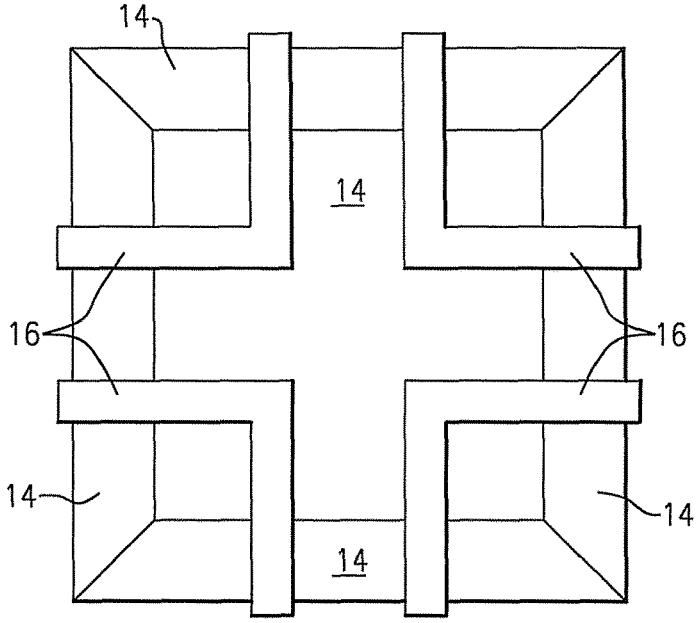
Figure 5:
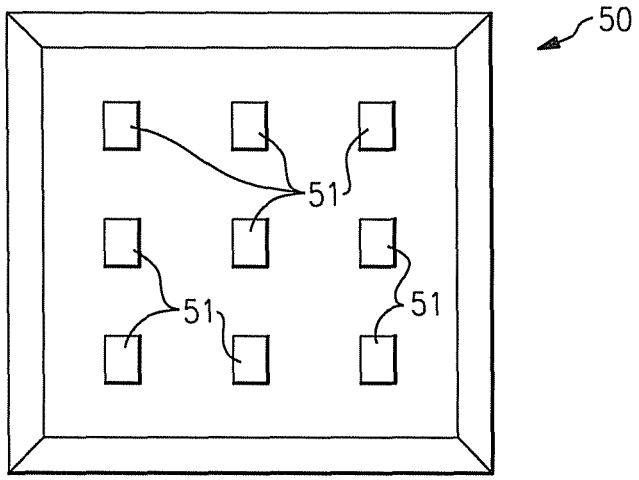
FIG. 5 is a sectional view of another lighting device 50 according to the present inventive subject matter.

FIG. 5 is a sectional view of another lighting device 50 according to the present inventive subject matter. The lighting device 50 depicted in FIG. 5 is similar to the lighting device 10 depicted in FIGS. 1-4, except that instead of four substrates 11, each having five solid state light emitters mounted on each substrate (in the lighting device 10), the lighting device 50 has nine substrates 51, each having eight solid state light emitters (not shown) on each substrate. The plane along which the view depicted in FIG. 5 is taken relative to the lighting device 50 is analogous to the plane along which the view depicted in FIG. 2 is taken relative to the lighting device 10 (i.e., in each case, the plane along which the view is taken is substantially parallel to the optical device and is between the optical device and the solid state light emitters). The arrangement depicted in FIG. 5 is suitable for a lighting device that can be mounted in a space that measures, for example, two feet by two feet (or other dimensions).

Figure 6:
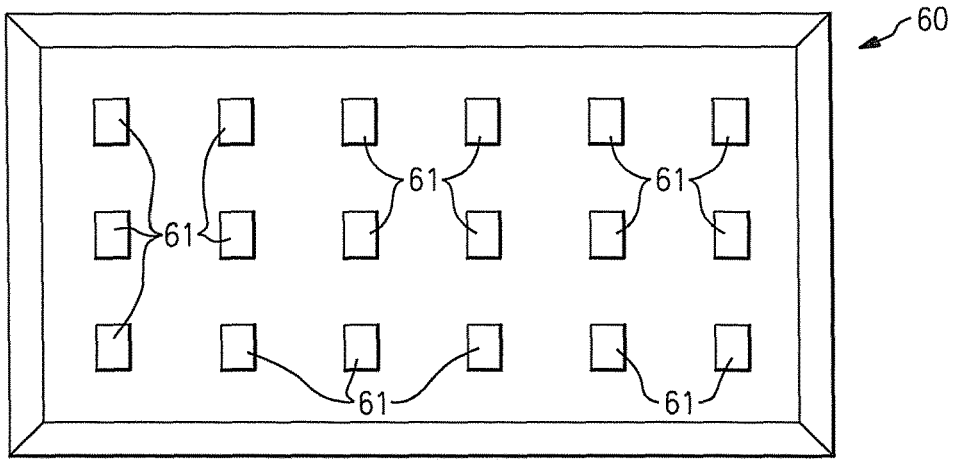
FIG. 6 is a sectional view of another lighting device 60 according to the present inventive subject matter.

FIG. 6 is a sectional view of another lighting device 60 according to the present inventive subject matter. The lighting device 60 depicted in FIG. 6 is similar to the lighting device 10 depicted in FIGS. 1-4, except that instead of four substrates 11, each having five solid state light emitters mounted on each substrate (in the lighting device 10), the lighting device 60 has eighteen substrates 61, each having three solid state light emitters (not shown) on each substrate. The plane along which the view depicted in FIG. 6 is taken relative to the lighting device 60 is analogous to the plane along which the view depicted in FIG. 2 is taken relative to the lighting device 10 (i.e., in each case, the plane along which the view is taken is substantially parallel to the optical device and is between the optical device and the solid state light emitters). The arrangement depicted in FIG. 6 is suitable for a lighting device that can be mounted in a space that measures, for example, two feet by four feet (or other dimensions).

While illustrated embodiments of the present inventive subject matter are shown as lighting devices with substantially flat square or rectangular light emission surfaces (e.g., as replacements for troffer lamps), the present inventive subject matter is applicable to all other types of lighting devices, mounting arrangements and shapes. As an example, lighting devices according to the present inventive subject matter can be of any other size, shape and/or form factor, e.g., in the shape of (and/or corresponding to) A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc.

While there is much discussion herein of the merits of solid state light emitters, many aspects of the present inventive subject matter as discussed herein can be applied to other light sources, e.g., incandescent light sources, fluorescent light sources, etc.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices and the fixture structures described herein can be integrated. Any structural part of the lighting devices and the fixture structures described herein can be provided in two or more parts (which may be held together in any known way, e.g., with adhesive, screws, bolts, rivets, staples, etc.).

The invention claimed is:

1. A lighting device, comprising:

a plurality of light emitting diode chips, at least some of the plurality of light emitting diode chips in a first cluster of light emitting diode chips;

at least a first optical device having at least a first light exit surface; and at least a first heat conductor, the first optical device configured to enhance uniformity of light emitted from the light emitting diode chips and emerging from the first light exit surface, the first heat conductor in thermal communication with the light emitting diode chips in the first cluster of light emitting diode chips, the first heat conductor substantially L-shaped, comprising a first heat conductor first elongated section and a first heat conductor second elongated section, a first portion of the first heat conductor first elongated section extending in a first plane in a first direction from an intersection between the first heat conductor first elongated section and the first heat conductor second elongated section, a first portion of the first heat conductor second elongated section extending in the first plane in a second direction from the intersection between the first heat conductor first elongated section and the first heat conductor second elongated section, the second direction substantially perpendicular to the first direction, the first portion of the first heat conductor first elongated section having a first elongated section first portion first direction heat conductivity in the first direction and a first elongated section first portion second direction heat conductivity in the second direction, the first elongated section first portion first direction heat conductivity at least twice the first elongated section first portion second direction heat conductivity, the first elongated section first portion second direction heat conductivity at least 1 W/(m K), the first portion of the first heat conductor second elongated section having a second elongated section first portion first direction heat conductivity in the first direction and a second elongated section first portion second direction heat conductivity in the second direction, the second elongated section first portion second direction heat conductivity at least twice the second elongated section first portion first direction heat conductivity, the second elongated section first portion first direction heat conductivity at least 1 W/(mK).

2. A lighting device as recited in claim 1, wherein:

the lighting device further comprises at least a first substrate and a second substrate, at least a first light emitting diode chip is mounted on a first surface of the first substrate, at least a second light emitting diode chip is mounted on a first surface of the second substrate, a combined surface area of the first surface of the first substrate and the first surface of the second substrate is less than 50 percent of a surface area of the first light exit surface.

3. A lighting device as recited in claim 1, wherein:

the lighting device further comprises at least a first reflective structure, the total number of light emitting diode chips in the lighting device are within a space defined by the first reflective structure and the first optical device.

4. A lighting device as recited in claim 1, wherein light emitted from the lighting device and emerging from each of at least 1000 non-overlapping conceptual square regions of the first light exit surface having a color hue that is within 0.01 unit of a first color point on a 1976 CIE Chromaticity Diagram and a brightness that is within 5 percent of a first brightness when energy is supplied to the lighting device, each of the at least 1000 non-overlapping conceptual square regions comprising 0.08 percent of a total surface area of the first light exit surface.

5. A lighting device as recited in claim 1, wherein an average distance between each light emitting diode chip and its nearest neighboring light emitting diode chip is less than the value of (a surface area of the first light exit surface divided by a total number of light emitting diode chips in the lighting device)$^{1/2}$, divided by five.

6. A lighting device as recited in claim 1, wherein:

said lighting device comprises at least second, third and fourth clusters of light emitting diode chips in addition to said first cluster of light emitting diode chips, each of said first, second, third and fourth clusters comprises at least five light emitting diode chips, and a number of conceptual circular regions that together make up less than 35 percent of the area of the light exit surface encompass at least 90 percent of the light emitting diode chips in said first, second, third and fourth clusters, said number of conceptual circular regions equal to one third of a quantity of said light emitting diode chips in said lighting device.

7. A lighting device as recited in claim 1, wherein:

said lighting device comprises at least second, third and fourth clusters of light emitting diode chips in addition to said first cluster of light emitting diode chips, each of said first, second, third and fourth clusters comprises at least five light emitting diode chips, and said lighting device further comprises a reflective structure, and for each of said first, second, third and fourth clusters, either the reflective structure is between the first heat conductor and the cluster, or the first heat conductor is between the reflective structure and the cluster.

8. A lighting device as recited in claim 1, wherein:

the first portion of the first elongated section has a first length and a first width, the first length is longer than the first width, the first portion of the second elongated section has a second length and a second width, and the second length is longer than the second width.

9. A lighting device as recited in claim 1, wherein the first optical device comprises at least one hole configured to enhance uniformity of light emitted from the light emitting diode chips and emerging from the first light exit surface.

10. A lighting device as recited in claim 1, wherein the first optical device comprises a plurality of holes that extend from a first light entrance surface of the first optical device to the first light exit surface, said plurality of holes configured to enhance uniformity of light emitted from the light emitting diode chips and emerging from the first light exit surface.

11. A lighting device as recited in claim 1, wherein the intersection between the first heat conductor first elongated section and the first heat conductor second elongated section is aligned with the first cluster of light emitting diode chips in a direction perpendicular to the first light exit surface.

12. A lighting device, comprising:

a first cluster of light emitting diode chips, a second cluster of light emitting diode chips, a third cluster of light emitting diode chips, and a fourth cluster of light emitting diode chips;

at least a first optical device having at least a first light exit surface; and at least a first heat conductor, a second heat conductor, a third heat conductor and a fourth heat conductor, light emitted from the lighting device and emerging from each of at least 1000 non-overlapping conceptual square regions of the first light exit surface having a color hue that is within 0.01 unit of a first color point on a 1976 CIE Chromaticity Diagram and a brightness that is within 5 percent of a first brightness when energy is supplied to the lighting device, each of the at least 1000 non-overlapping conceptual square regions comprising 0.08 percent of a total surface area of the first light exit surface, the first heat conductor is substantially L-shaped, comprising a first heat conductor first elongated section and a first heat conductor second elongated section, the first heat conductor in thermal communication with the light emitting diode chips, the first heat conductor first elongated section having a first heat conductivity in a first direction and a second heat conductivity in a second direction, the first heat conductivity at least twice the second heat conductivity, the second heat conductivity at least 1 W/(m K), the second heat conductor is substantially L-shaped, comprising a second heat conductor first elongated section and a second heat conductor second elongated section, the third heat conductor is substantially L-shaped, comprising a third heat conductor first elongated section and a third heat conductor second elongated section, the fourth heat conductor is substantially L-shaped, comprising a fourth heat conductor first elongated section and a fourth heat conductor second elongated section, a first portion of the first heat conductor first elongated section extends from an intersection between the first heat conductor first elongated section and the first heat conductor second elongated section away from the second heat conductor, a first portion of the first heat conductor second elongated section extends from the intersection between the first heat conductor first elongated section and the first heat conductor second elongated section away from the third heat conductor, a first portion of the second heat conductor first elongated section extends from an intersection between the second heat conductor first elongated section and the second heat conductor second elongated section away from the first heat conductor, a first portion of the second heat conductor second elongated section extends from the intersection between the second heat conductor first elongated section and the second heat conductor second elongated section away from the fourth heat conductor, a first portion of the third heat conductor first elongated section extends from an intersection between the third heat conductor first elongated section and the third heat conductor second elongated section away from the fourth heat conductor, a first portion of the third heat conductor second elongated section extends from the intersection between the third heat conductor first elongated section and the third heat conductor second elongated section away from the first heat conductor, a first portion of the fourth heat conductor first elongated section extends from an intersection between the fourth heat conductor first elongated section and the fourth heat conductor second elongated section away from the third heat conductor, and a first portion of the fourth heat conductor second elongated section extends from the intersection between the fourth heat conductor first elongated section and the fourth heat conductor second elongated section away from the second heat conductor.

13. A lighting device as recited in claim 12, wherein:

the lighting device further comprises at least a first substrate and a second substrate, the first light emitting diode chip is mounted on a first surface of the first substrate, the second light emitting diode chip is mounted on a first surface of the second substrate, a combined surface area of the first surface of the first substrate and the first surface of the second substrate is less than 50 percent of a surface area of the first light exit surface.

14. A lighting device as recited in claim 12, wherein at least 80 percent of a total amount of light emitted by the total number of light emitting diode chips in the lighting device emerges from the first light exit surface.

15. A lighting device as recited in claim 12, wherein:

the lighting device further comprises at least a first reflective structure, the total number of light emitting diode chips in the lighting device are within a space defined by the first reflective structure and the first optical device.

16. A lighting device as recited in claim 12, wherein an average distance between each light emitting diode chip and its nearest neighboring light emitting diode chip is less than the value of (a surface area of the first light exit surface divided by a total number of light emitting diode chips in the lighting device)$^{1/2}$, divided by five.

17. A lighting device as recited in claim 12, wherein:

each of said first, second, third and fourth clusters comprises at least five light emitting diode chips, and a number of conceptual circular regions that together make up less than 35 percent of the area of the light exit surface encompass at least 90 percent of the light emitting diode chips in said at least four clusters, said number of conceptual circular regions equal to one third of a quantity of said light emitting diode chips in said lighting device.

18. A lighting device as recited in claim 12, wherein:

each of said first, second, third and fourth clusters comprises at least five light emitting diode chips, said lighting device further comprises a reflective structure, and for each cluster, either the reflective structure is between the first heat conductor and the cluster, or the first heat conductor is between the reflective structure and the cluster.

19. A lighting device as recited in claim 12, wherein:

the first portion of the first elongated section has a first length and a first width, the first length is longer than the first width, the first portion of the second elongated section has a second length and a second width, and the second length is longer than the second width.

20. A lighting device as recited in claim 12, wherein the first optical device comprises at least one hole configured to enhance uniformity of light emitted from the light emitting diode chips and emerging from the first light exit surface.

21. A lighting device as recited in claim 12, wherein the first optical device comprises a plurality of holes that extend from a first light entrance surface of the first optical device to the first light exit surface, said plurality of holes configured to enhance uniformity of light emitted from the light emitting diode chips and emerging from the first light exit surface.

22. A lighting device as recited in claim 12, wherein:

the intersection between the first heat conductor first elongated section and the first heat conductor second elongated section is aligned with the first cluster of light emitting diode chips in a direction perpendicular to the first light exit surface, the intersection between the second heat conductor first elongated section and the second heat conductor second elongated section is aligned with the second cluster of light emitting diode chips in a direction perpendicular to the first light exit surface, the intersection between the third heat conductor first elongated section and the third heat conductor second elongated section is aligned with the third cluster of light emitting diode chips in a direction perpendicular to the first light exit surface, and the intersection between the fourth heat conductor first elongated section and the fourth heat conductor second elongated section is aligned with the fourth cluster of light emitting diode chips in a direction perpendicular to the first light exit surface.

23. A lighting device comprising:

a first heat conductor, a second heat conductor, a third heat conductor and a fourth heat conductor;

a first cluster of light emitting diode chips, a second cluster of light emitting diode chips, a third cluster of light emitting diode chips, and a fourth cluster of light emitting diode chips; and at least a first optical device having at least a first light exit surface, the first optical device configured to enhance uniformity of light emitted from the light emitting diode chips and emerging from the first light exit surface, the first heat conductor in thermal communication with the light emitting diode chips, the first heat conductor having a first heat conductivity in a first direction and a second heat conductivity in a second direction, the first heat conductivity at least twice the second heat conductivity, the second heat conductivity at least 1 W/(m K), the first heat conductor is substantially L-shaped, comprising a first heat conductor first elongated section and a first heat conductor second elongated section, an intersection between the first heat conductor first elongated section and the first heat conductor second elongated section aligned with the first cluster of light emitting diode chips in a direction perpendicular to the first light exit surface, the second heat conductor is substantially L-shaped, comprising a second heat conductor first elongated section and a second heat conductor second elongated section, an intersection between the second heat conductor first elongated section and the second heat conductor second elongated section aligned with the second cluster of light emitting diode chips in said direction perpendicular to the first light exit surface, the third heat conductor is substantially L-shaped, comprising a third heat conductor first elongated section and a third heat conductor second elongated section, an intersection between the third heat conductor first elongated section and the third heat conductor second elongated section aligned with the third cluster of light emitting diode chips in said direction perpendicular to the first light exit surface, the fourth heat conductor is substantially L-shaped, comprising a fourth heat conductor first elongated section and a fourth heat conductor second elongated section, an intersection between the fourth heat conductor first elongated section and the fourth heat conductor second elongated section aligned with the fourth cluster of light emitting diode chips in said direction perpendicular to the first light exit surface, the first heat conductor first elongated section extends away from the second heat conductor, the first heat conductor second elongated section extends away from the third heat conductor, the second heat conductor first elongated section extends away from the first heat conductor, the second heat conductor second elongated section extends away from the fourth heat conductor, the third heat conductor first elongated section extends away from the fourth heat conductor, the third heat conductor second elongated section extends away from the first heat conductor, the fourth heat conductor first elongated section extends away from the third heat conductor, and the fourth heat conductor second elongated section extends away from the second heat conductor.

24. A lighting device comprising:

a first heat conductor, a second heat conductor, a third heat conductor and a fourth heat conductor;

a first cluster of light emitting diode chips, a second cluster of light emitting diode chips, a third cluster of light emitting diode chips, and a fourth cluster of light emitting diode chips; and at least a first optical device having at least a first light exit surface, the first heat conductor is substantially L-shaped, comprising a first heat conductor first elongated section and a first heat conductor second elongated section, an intersection between the first heat conductor first elongated section and the first heat conductor second elongated section aligned with the first cluster of light emitting diode chips in a direction perpendicular to the first light exit surface, the second heat conductor is substantially L-shaped, comprising a second heat conductor first elongated section and a second heat conductor second elongated section, an intersection between the second heat conductor first elongated section and the second heat conductor second elongated section aligned with the second cluster of light emitting diode chips in said direction perpendicular to the first light exit surface, the third heat conductor is substantially L-shaped, comprising a third heat conductor first elongated section and a third heat conductor second elongated section, an intersection between the third heat conductor first elongated section and the third heat conductor second elongated section aligned with the third cluster of light emitting diode chips in said direction perpendicular to the first light exit surface, the fourth heat conductor is substantially L-shaped, comprising a fourth heat conductor first elongated section and a fourth heat conductor second elongated section, an intersection between the fourth heat conductor first elongated section and the fourth heat conductor second elongated section aligned with the fourth cluster of light emitting diode chips in said direction perpendicular to the first light exit surface, the first heat conductor first elongated section extends away from the second heat conductor, the first heat conductor second elongated section extends away from the third heat conductor, the second heat conductor first elongated section extends away from the first heat conductor, the second heat conductor second elongated section extends away from the fourth heat conductor, the third heat conductor first elongated section extends away from the fourth heat conductor, the third heat conductor second elongated section extends away from the first heat conductor, the fourth heat conductor first elongated section extends away from the third heat conductor, the fourth heat conductor second elongated section extends away from the second heat conductor, light emitted from the lighting device and emerging from each of at least 1000 non-overlapping conceptual square regions of the first light exit surface having a color hue that is within 0.01 unit of a first color point on a 1976 CIE Chromaticity Diagram and a brightness that is within 5 percent of a first brightness when energy is supplied to the lighting device, each of the at least 1000 non-overlapping conceptual square regions comprising 0.08 percent of a total surface area of the first light exit surface, the first heat conductor in thermal communication with the light emitting diode chips, the first heat conductor having a first heat conductivity in a first direction and a second heat conductivity in a second direction, the first heat conductivity at least twice the second heat conductivity, the second heat conductivity at least 1 W/(m K).

* * * * *